US007293995B2

(12) United States Patent
Li

(10) Patent No.: US 7,293,995 B2
(45) Date of Patent: Nov. 13, 2007

(54) ELECTRICAL CONTACT AND CONNECTOR SYSTEM

(75) Inventor: Che-Yu Li, Roslyn, NY (US)

(73) Assignee: Che-Yu Li & Company, LLC, Ithaca, NY (US)

( * ) Notice: Subject to any disclaimer, the term of this patent is extended or adjusted under 35 U.S.C. 154(b) by 19 days.

(21) Appl. No.: 11/334,993

(22) Filed: Jan. 18, 2006

(65) Prior Publication Data

US 2007/0105406 A1 May 10, 2007

Related U.S. Application Data

(60) Provisional application No. 60/734,607, filed on Nov. 8, 2005.

(51) Int. Cl.
*H01R 12/00* (2006.01)

(52) U.S. Cl. ..... 439/66; 174/265

(58) Field of Classification Search ..... 439/66–69; 174/265, 177

See application file for complete search history.

(56) References Cited

U.S. PATENT DOCUMENTS

| | | | | |
|---|---|---|---|---|
| 2,154,247 | A * | 4/1939 | Muldoon et al. | 439/817 |
| 2,163,177 | A | 4/1939 | Ecker | |
| 3,115,337 | A * | 12/1963 | Musgrave | 267/151 |
| 3,317,885 | A | 5/1967 | Yost | |
| 3,513,434 | A | 5/1970 | Zielke | |
| 3,562,798 | A * | 2/1971 | Bragg | 439/67 |
| 3,795,884 | A | 3/1974 | Kotaka | |
| 4,029,375 | A | 6/1977 | Gabrielian | |
| 4,161,346 | A * | 7/1979 | Cherian et al. | 439/66 |
| 4,805,885 | A * | 2/1989 | Gingerich et al. | 267/165 |
| 4,810,213 | A | 3/1989 | Chabot | |
| 4,820,376 | A | 4/1989 | Lambert et al. | |
| 4,838,815 | A | 6/1989 | Tajima et al. | |
| 4,902,857 | A * | 2/1990 | Cranston et al. | 174/94 R |
| 4,922,376 | A | 5/1990 | Pommer et al. | |
| 5,030,109 | A | 7/1991 | Dery | |
| 5,061,191 | A | 10/1991 | Casciotti et al. | |
| 5,232,372 | A | 8/1993 | Bradley et al. | |
| 5,427,535 | A * | 6/1995 | Sinclair | 439/66 |
| 5,473,510 | A | 12/1995 | Dozier, II | |
| 5,618,189 | A * | 4/1997 | Jin et al. | 439/91 |
| 6,568,583 | B2 * | 5/2003 | Yumi et al. | 228/180.5 |

(Continued)

*Primary Examiner*—James R. Harvey
(74) *Attorney, Agent, or Firm*—Brown & Michaels, PC

(57) ABSTRACT

An electrical contact formed from a compliant folded sheet that includes a top surface, a bottom surface, a first contact edge and a second contact edge. A plurality of corrugations are formed in the top surface and the bottom surface that terminate at the first contact edge and the second contact edge. A connector system having a housing that has a plurality of through openings. A plurality of electrical contacts, each being formed from a compliant folded sheet that includes a top surface, a bottom surface, a first contact edge and a second contact edge. A plurality of corrugations are formed in the top surface and the bottom surface that terminate at the first contact edge and the second contact edge. Each of the electrical contacts is arranged within a corresponding one of the plurality of through openings such that the first contact edge is positioned outside of the through-opening in which electrical contact is positioned, and the second contact edge is positioned outside of the through-opening in which electrical contact is positioned, but spaced from the first contact edge.

34 Claims, 31 Drawing Sheets

U.S. PATENT DOCUMENTS 6,788,463 B2 * 9/2004 Merrill et al. ..... 359/494
7,052,285 B2 * 5/2006 Wu et al. ..... 439/67
7,056,129 B2 * 6/2006 Kobayashi et al. ..... 439/66
2004/0002234 A1 * 1/2004 Masao et al. ..... 439/66

* cited by examiner

ELECTRICAL CONTACT AND CONNECTOR SYSTEM

This application claims priority from co-pending Provisional Patent Application Ser. No. 60/734,607, filed Nov. 8, 2005, and entitled Electrical Contact And Connector System.

FIELD OF THE INVENTION

The present invention generally relates to interconnection systems for high speed electronics systems, and more particularly to an electrical contact assembly and connector system that is adapted for use in electronic systems that are capable of high speed data transmission.

BACKGROUND OF THE INVENTION

High density integrated circuit (IC) packages that house LSI/VLSI type semiconductor devices are well known. Input/output contacts for such IC packages are often arranged in such a dense pattern (sometimes more than five hundred closely spaced contacts) that direct soldering of the IC package to a substrate, such as a printed wiring or circuit board (PCB) creates several significant problems related to inspection and correction of any resulting soldering faults as well as thermal expansion mismatch failures.

Land grid array (LGA) connectors are known for interconnecting IC packages to PCB's. LGA's typically do not require soldering procedures during engagement with the PCB. Referring to FIG. 1, prior art LGA assemblies are used to interconnect an IC package A having a plurality of contact pads or bumps B formed on a bottom surface, to contact pads C arranged in a regular pattern on a surface of printed wiring board or printed circuit board (PCB) D. Current technology permits conductive pads B and conductive pads C to be disposed at center-to-center spacings (as indicated by dimension "a" in FIG. 1) of approximately one half to one millimeter, with further miniaturization possible and inevitable.

Prior art LGA assemblies E are known which include an insulative housing and a plurality of resilient conductive contacts F received in passageways formed in the housing. The resilient conductive contacts typically have exposed portions at the upper and lower surfaces of the insulative housing for engaging flat contact pads B,C. When IC package A is accurately positioned in overlying aligned engagement with PCB D, such that conductive pads B engage conductive pads C, a normal force is applied to the exposed portions of each resilient conductive contact to electrically and mechanically engage the respective contact pads.

The resilient conductive contacts associated with prior art LGA's have had a variety of shapes. A commonly used form of resilient conductive contact includes two free ends connected by a curved portion which provides for the storage of elastic energy during engagement with the IC package and PCB. Prior art resilient conductive contacts are usually a single metal structure in the form of a spring to provide the required elastic response during service while also serving as a conductive element for electrical connection. Typically, a combination of barrier metal and noble metal platings is applied to the surface of the spring for corrosion prevention and for electrical contact enhancement. It is often the case that these platings are not of sufficient thickness for electrical conduction along the surface of the spring. Examples of such prior art resilient conductive contacts may be found in U.S. Pat. Nos. 2,153,177; 3,317,885; 3,513,434; 3,795,884; 4,029,375; 4,810,213; 4,820,376; 4,838,815; 4,922,376; 5,030,109; 5,061,191; 5,232,372; and 5,473,510. The foregoing patents are hereby incorporated herein by reference.

A problem exists in the high density electrical interconnection art in that a good material for the construction of a spring, such as a high strength steel, is not a very good electrical conductor. On the other hand, a good electrical conductor, such as a copper alloy or precious metal, is often not a good spring material. There is a need for a simplified resilient conductive contact which incorporates the seemingly opposing requirements of good spring properties and high conductivity. Additionally, attributes, missing from the prior art that are necessary for a universally applicable electrical contact include: (i) extendibility to a large contact array at fine pitch, i.e., five mils (thousandths of an inch) or less and (ii) spring members of relatively small size but high elastic compliance, i.e., spring members capable of deflections in the elastic range of as much as thirty percent of their uncompressed or undeflected height, and with low contact force, i.e., less than twenty grams per contact. In addition, such a universally applicable electrical contact will be capable of high frequency transmittance of signals greater than ten gigahertz, which would require a small self-inductance and therefore a short contact height. Also, a universally applicable electrical contact will be capable of high current capacity, i.e., having less than ten milliohm bulk resistance per contact and low contact resistance. Furthermore, a universally applicable electrical contact will be capable of high durability or high cycles of touchdowns, i.e., greater than five hundred thousand cycles, which requires a spring having a high elastic compliance to avoid permanent set in contact height under repeated compressive loadings as well as high fatigue strength. Additionally, a universally applicable electrical contact will be capable of high reliability with minimum degradation in contact resistance which often requires a noble metal contact surface and redundancy in contact points. Also, a universally applicable electrical contact will be capable of high service temperatures, i.e., often exceeding two hundred and fifty degrees centigrade, which requires the structural part of the electrical contact to be made of high melting temperature metals to prevent the relaxation of contact force. All of the foregoing will be essential, but will only help solve the problems in the art if achieved with low cost manufacturing, using conventional high volume tools and processes.

Therefore, an improved electrical contact system and assembly for use in a wide variety of electrical connector and interface sockets and interposers is needed which can overcome the drawbacks of conventional electrical contacts and exhibit the foregoing attributes.

SUMMARY OF THE INVENTION

The present invention provides an electrical contact formed from a compliant folded sheet that includes a top surface, a bottom surface, a first contact edge and a second contact edge. A plurality of corrugations are formed in the top surface and the bottom surface that terminate at the first contact edge and the second contact edge. In one embodiment, the compliant folded sheet includes at least one crest corresponding to a top surface of a fold in the sheet and at least one trough corresponding to a bottom surface of a fold in the sheet. A plurality of longitudinally oriented corrugations are formed in the top surface of the folded sheet and the bottom surface of the folded sheet so as to form a plurality of longitudinally oriented ridges that are transversely spaced from one another by a plurality of longitudinally oriented furrows and that terminate at the first contact edge and the second contact edge.

In another embodiment of the invention, an electrical contact is provided that includes a plurality of wires in the form of a compound spring arranged one next to another and fastened to one another along an intermediate portion of their length so as to form a compliant sheet defining a plurality of independent cantilevered wires projecting outwardly from that intermediate portion.

The present invention also provides a connector system having a housing that has a plurality of through openings. A plurality of electrical contacts, each being formed from a compliant folded sheet that includes a top surface, a bottom surface, a first contact edge and a second contact edge. A plurality of corrugations are formed in the top surface and the bottom surface that terminate at the first contact edge and the second contact edge. Each of the electrical contacts is arranged within a corresponding one of the plurality of through openings such that the first contact edge is positioned outside of the through-opening in which electrical contact is positioned, and the second contact edge is positioned outside of the through-opening in which electrical contact is positioned, but spaced from the first contact edge.

In one embodiment of connector system, a carrier assembly is provided that includes a top sheet and a bottom sheet each being formed from an insulator coated metal, a rigid polymer, or a polymer composite and having an array of through-holes. An inactivated layer of adhesive is disposed between the top sheet and the bottom sheet so that the top sheet and the bottom sheet slide over one another so as to move from a first position to a second position. In the first position, the array of through-holes are arranged in coaxially aligned relation to one another thereby defining a first opening size. In a the second position, the top sheet and the bottom sheet are transversely shifted relative to one another thereby defining a second opening size that is narrower than the first opening size thereby grasping and holding on of a plurality of electrical contacts, with one of the electrical contacts located in a corresponding one of the through-holes. Each of the electrical contacts includes a compliant folded sheet including a top surface, a bottom surface, a first contact edge and a second contact edge. A plurality of corrugations are formed in the top surface and the bottom surface that terminate at the first contact edge and the second contact edge.

In another connector system, a carrier assembly is provided including a top sheet and a bottom sheet that are each formed from an insulator coated metal, a rigid polymer, or a polymer composite and have an array of through-holes. An inactivated layer of adhesive is disposed between the top sheet and the bottom sheet so that the top sheet and the bottom sheet slide over one another so as to move from a first position to a second position. In the first position, the array of through-holes are arranged in coaxially aligned relation to one another thereby defining a first opening size. In a the second position, the top sheet and the bottom sheet are transversely shifted relative to one another thereby defining a second opening size that is narrower than the first opening size thereby grasping and holding on of a plurality of electrical contacts, with one of the electrical contacts located in a corresponding one of the through-holes. Each of the electrical contacts includes a plurality of wires in the form of a compound spring arranged one next to another and fastened to one another along an intermediate portion of their length so as to form a compliant sheet defining a plurality of independent cantilevered wires projecting outwardly from the intermediate portion. The intermediate portion of each of the electrical contacts is located within a through-hole that comprises the second opening size.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
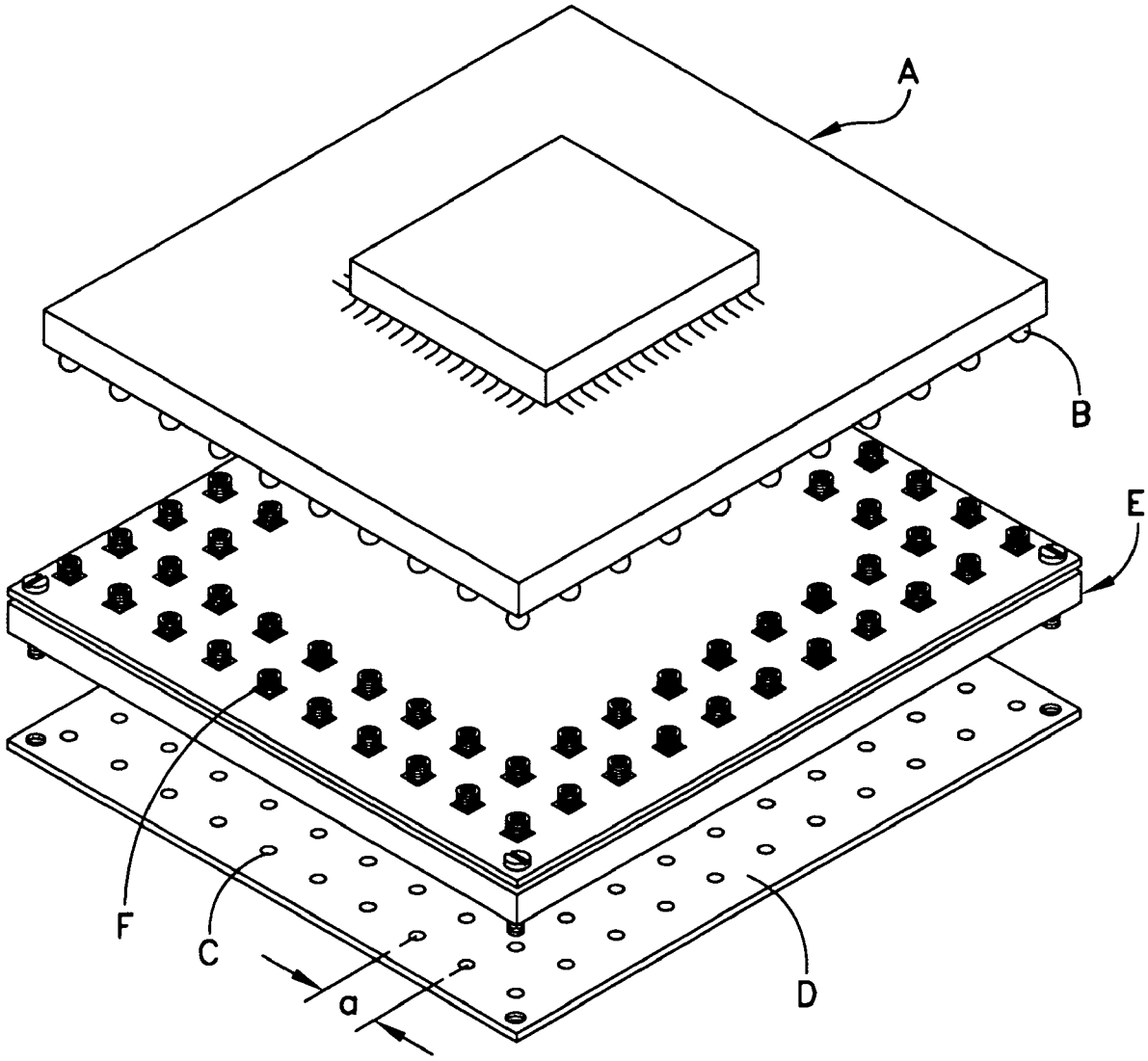
FIG. 1 (PRIOR ART)
FIG. 1 is an exploded perspective view of a prior art LGA assembly.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Figure 2:
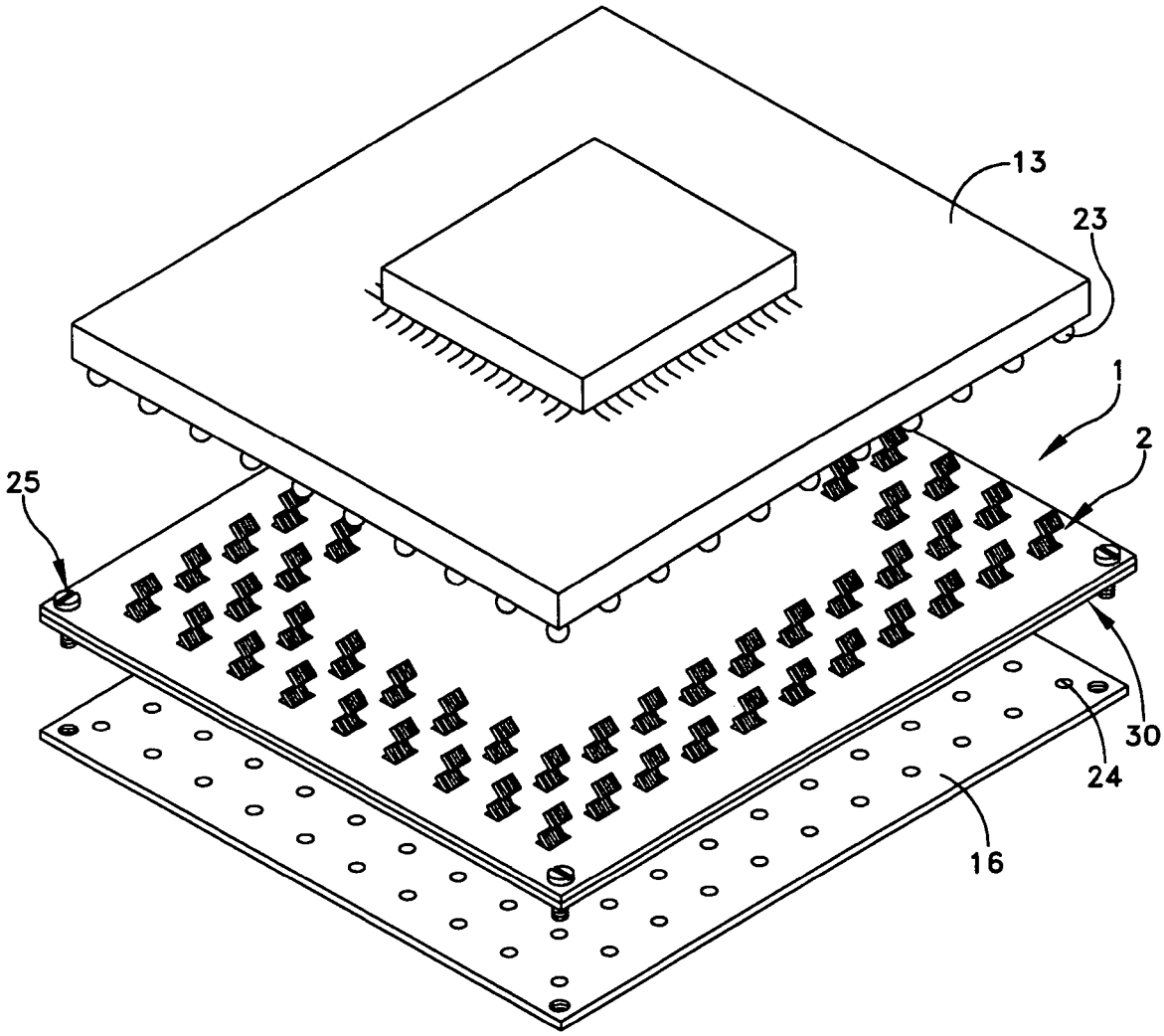
FIG. 2 is an exploded perspective view of a connector assembly formed in accordance with one embodiment of the present invention.
Figure 3:
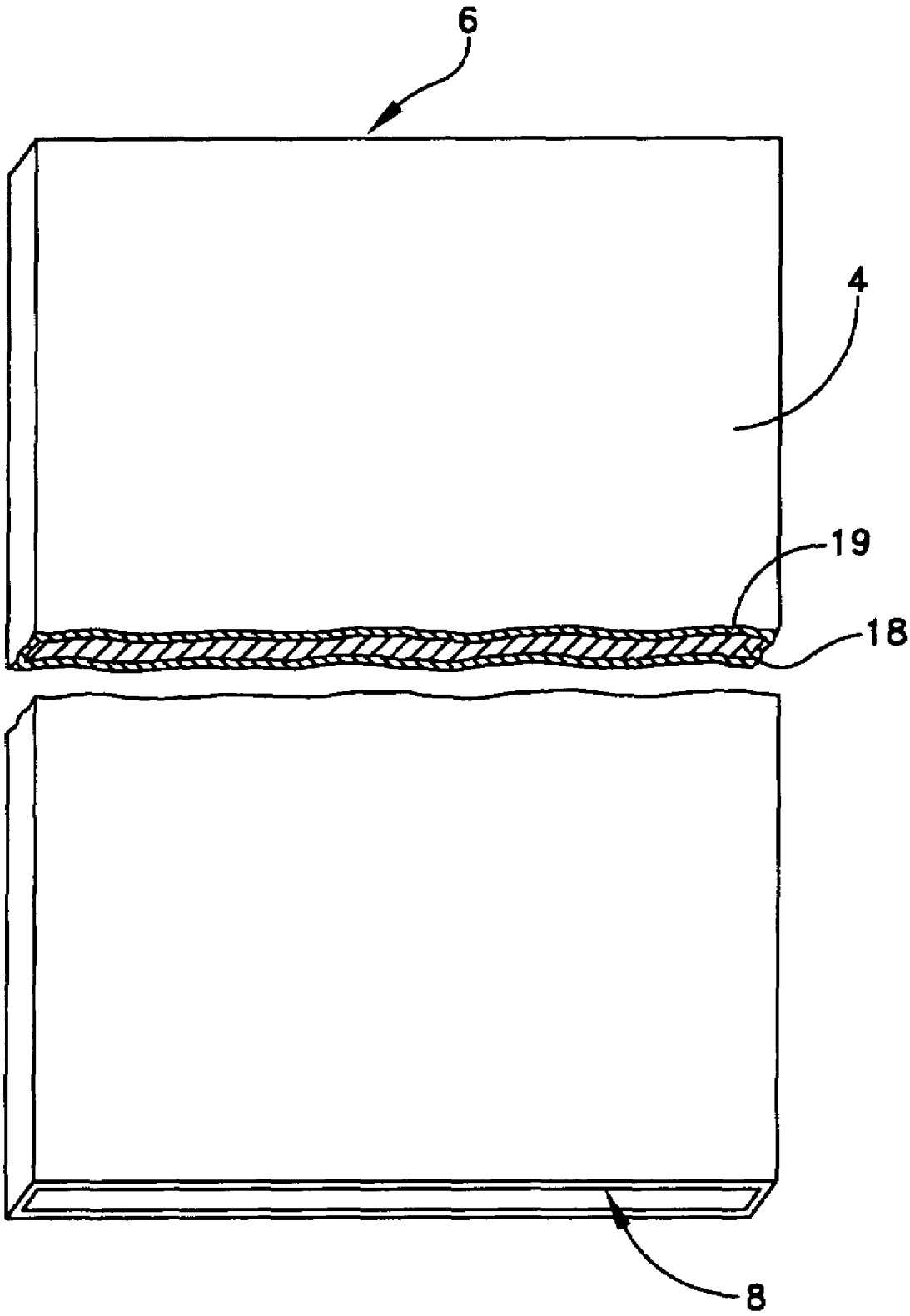
FIG. 3 is a perspective broken away and partially cross-sectioned portion of a base sheet formed in accordance with the present invention.
Figure 4:
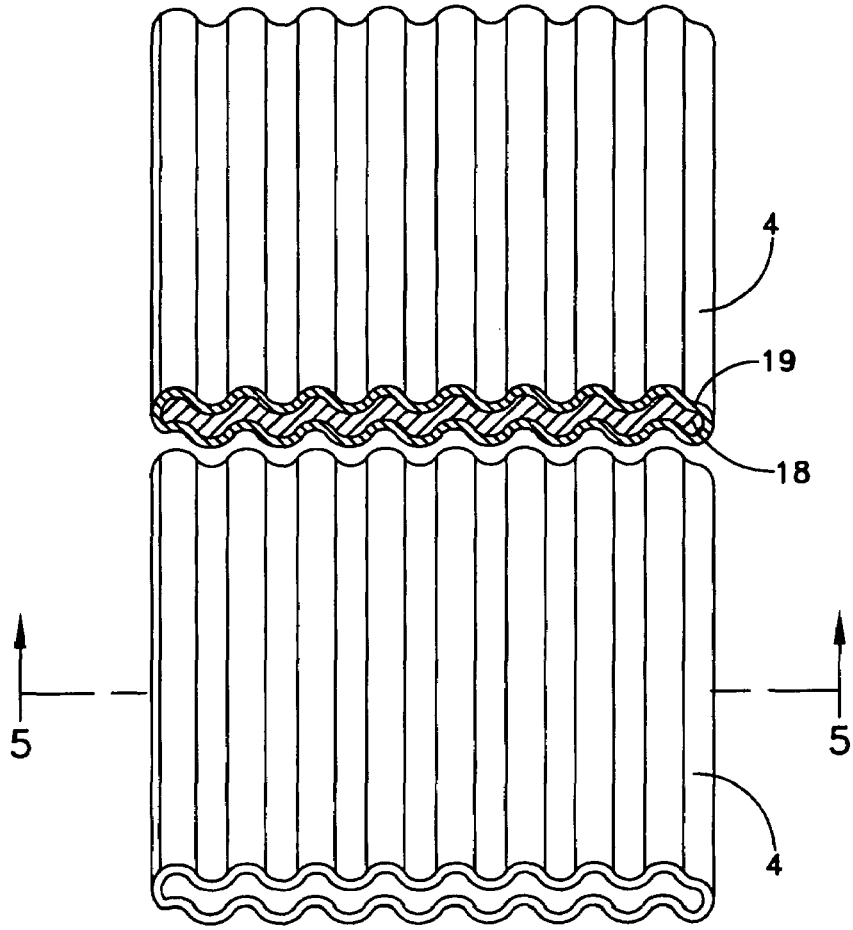
FIG. 4 is a perspective view of a base sheet similar to that shown in FIG. 3 but including a plurality of corrugations.
Figure 5:
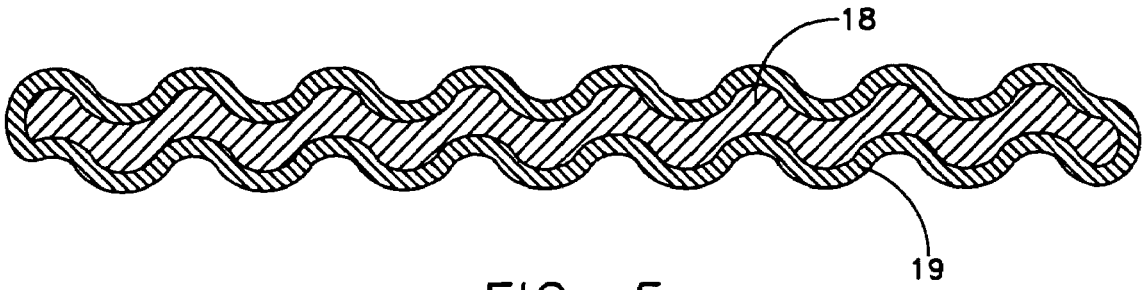
FIG. 5 is a cross-sectional view of the base sheet shown in FIG. 4, as taken along lines 5-5 in FIG. 4.

Referring to FIG. 2, an interconnection system 1 formed in accordance with the present invention comprises a plurality of electrical contacts 2 assembled within a carrier assembly 30 that is sized and shaped to effect an electrical interconnection between an integrated circuit package 13 and a PCB 16. In one embodiment, electrical contacts 2 comprise a pleat-like, folded structure formed from a base sheet 4 having a top contact edge 6, a bottom contact edge 8, a plurality of longitudinally oriented corrugations 10, and at least two transversely oriented crests 12 that are separated by at least two transversely oriented troughs 14. In one embodiment, electrical contacts 2 include a plurality of longitudinally oriented sinusoidal corrugations and four transversely oriented crests 12 that are separated by four transversely oriented troughs 14.

More particularly, each base sheet 4 is often formed from hardened stainless steel, comparable other metal alloys having high melting temperature characteristics, hardened high temperature compatible copper alloys, or their equivalent. Importantly, the metal sheet 18 used to form electrical contacts 2 should exhibit a high yield strength in the range from about 275 ksi to about 325 ksi, and most preferably 300 ksi or more. In one preferred embodiment, a vacuum melted, 304V stainless steel having a highly conductive metal coating 19 has been used to form base sheet 4 so as to provide high service temperature capability on the order of two hundred and fifty degrees centigrade while at the same time exhibiting high durability and high cycles of touchdowns that will exceed five hundred thousand cycles. This preferred material (304V stainless steel and related alloys) also provides the high elastic compliance which avoids permanent set in contact height under repeated compressive loadings and also exhibits high fatigue strength. A highly conductive metal coating 19 that has been found to yield adequate results includes a two hundred microinch to four hundred microinch copper layer for conductivity/bulk resistivity improvement, followed by a fifty microinch nickel barrier layer, and finally a fifty microinch gold outer layer. Of course, base sheet 4 may be electroplated, clad, laminated or otherwise coated with the forgoing metals in ways known in the art. The plating or cladding is often about ten percent to forty percent of the thickness of base sheet 4, and covers all sides except the cut surface adjacent to top contact edge 6 and bottom contact edge 8.

Figure 6:
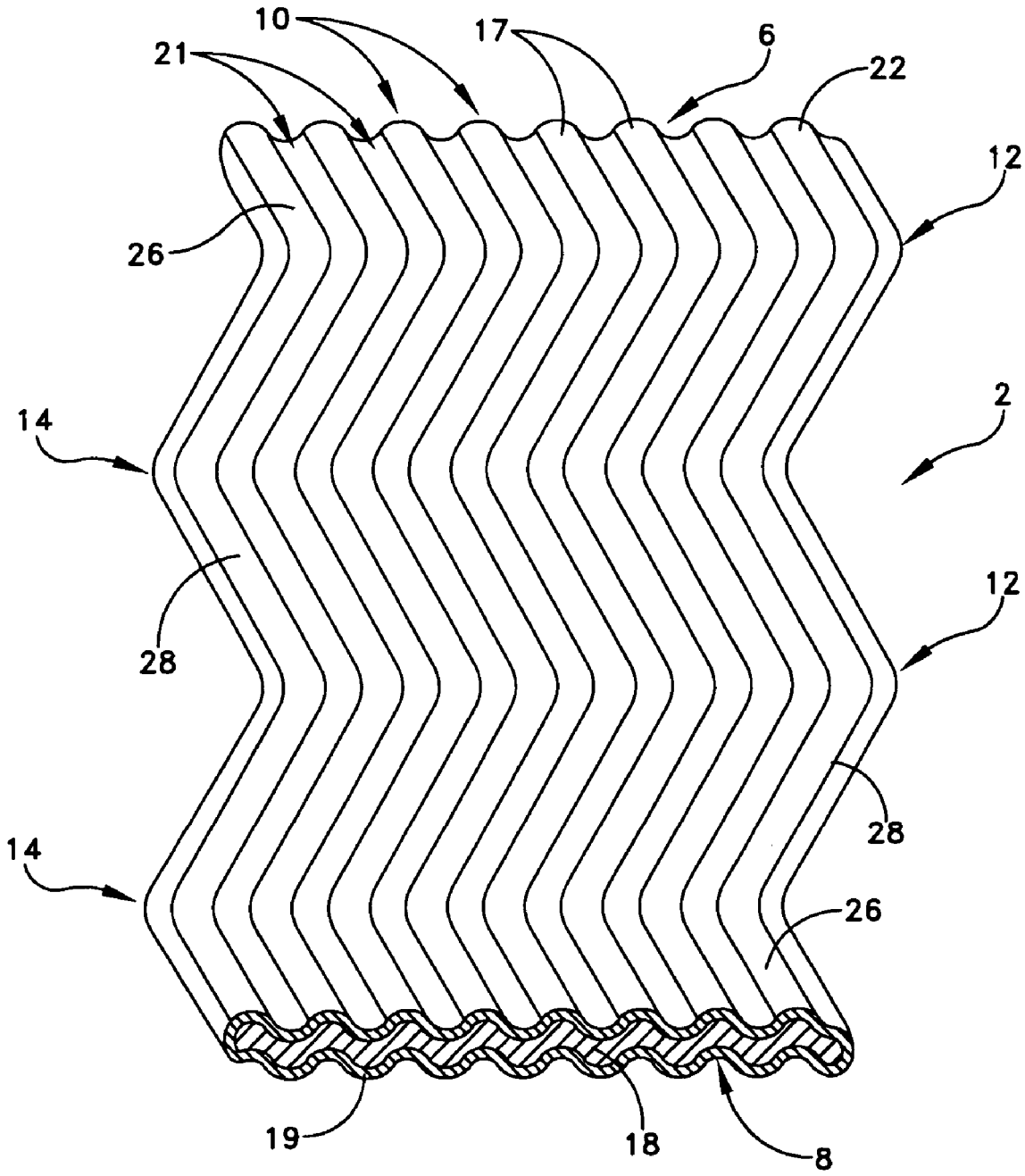
FIG. 6 is a perspective view of a folded electrical contact formed in accordance with the invention.
Figure 7:
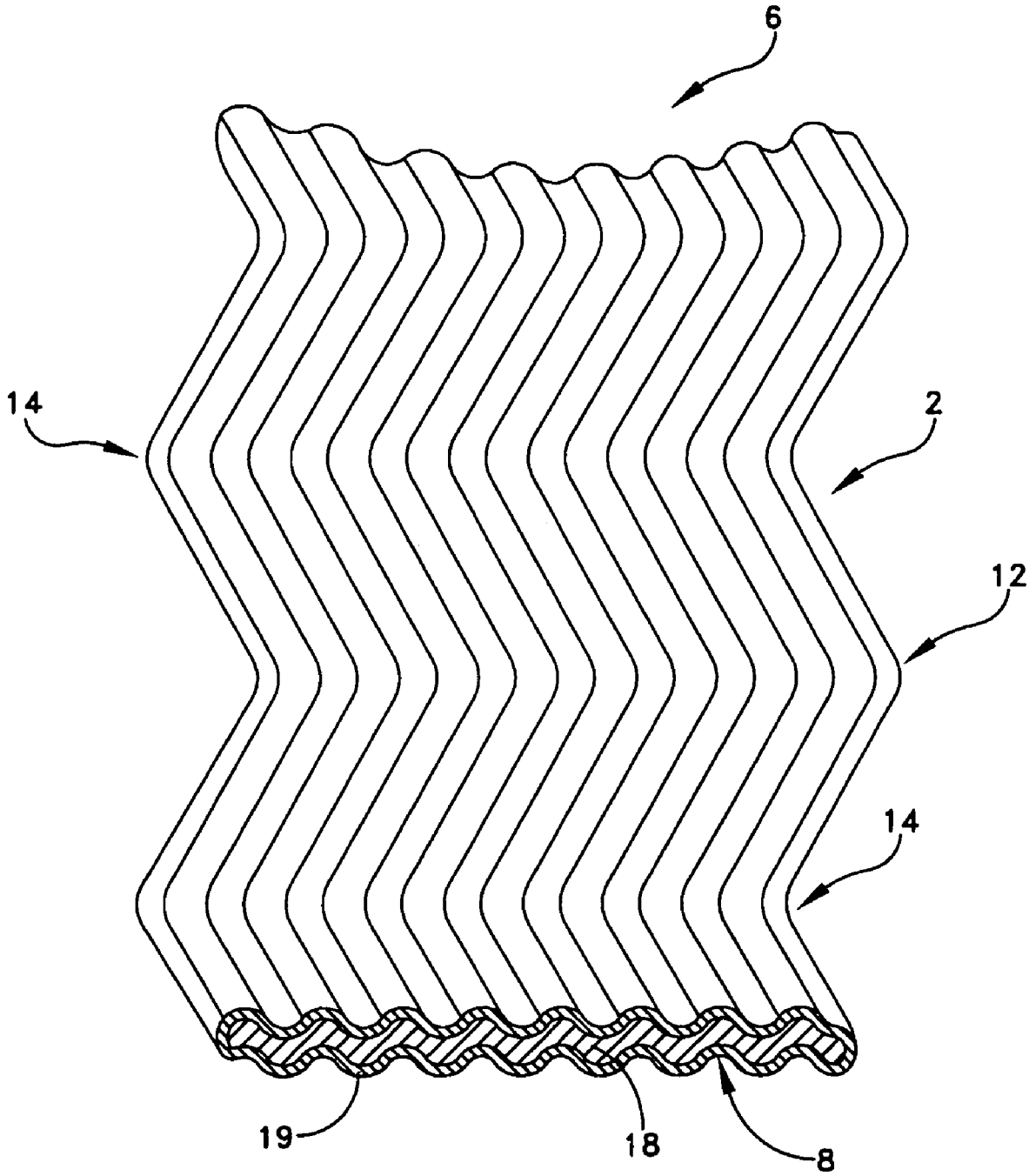
FIG. 7 is a perspective view of an alternative embodiment of folded electrical contact including a concave pad engagement edge.
Figure 8:
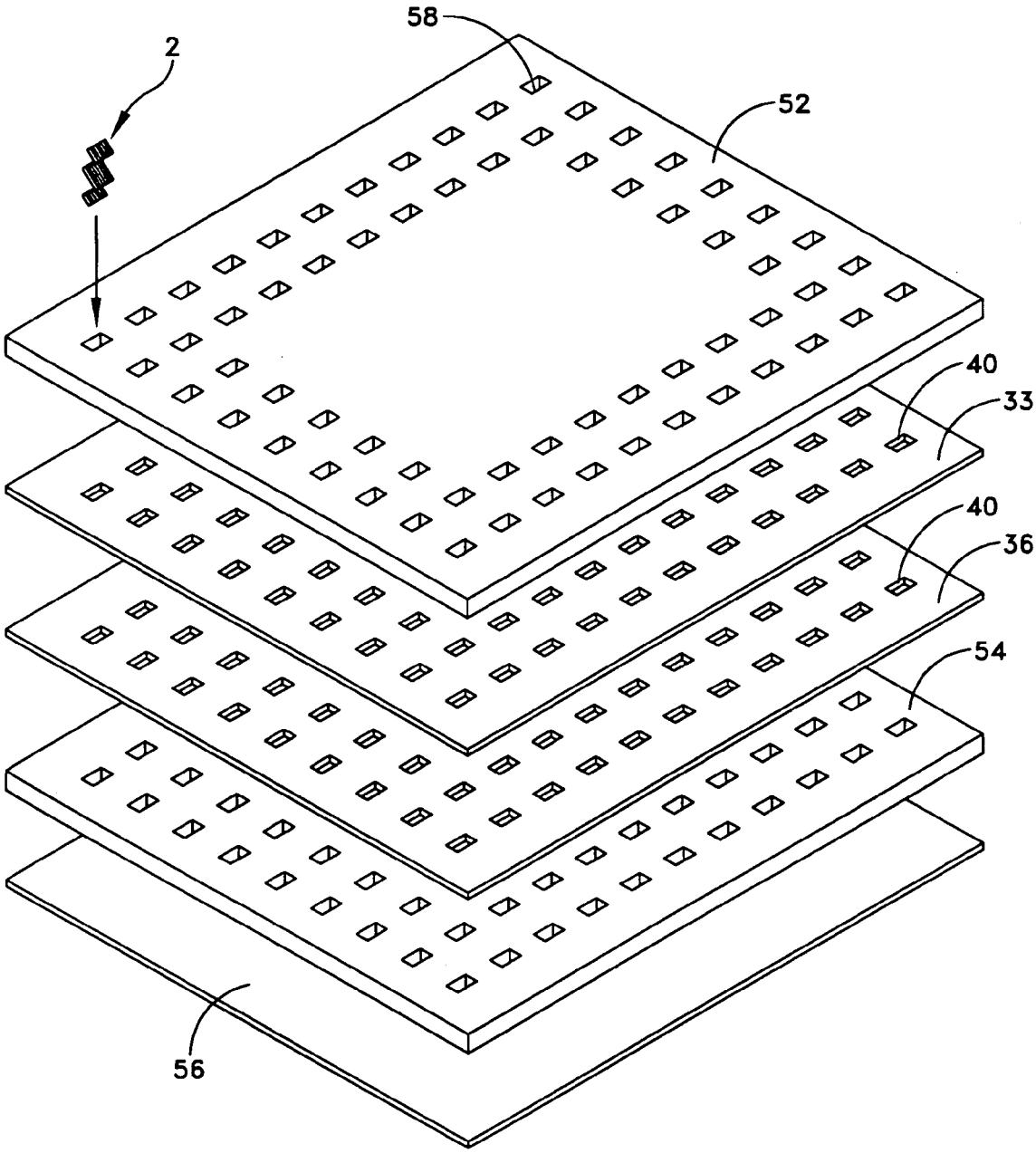
FIG. 8 is an exploded perspective view of a lamination stack and carrier assembly used to form a connector system including an electrical contact formed in accordance with the present invention.
Figure 9:
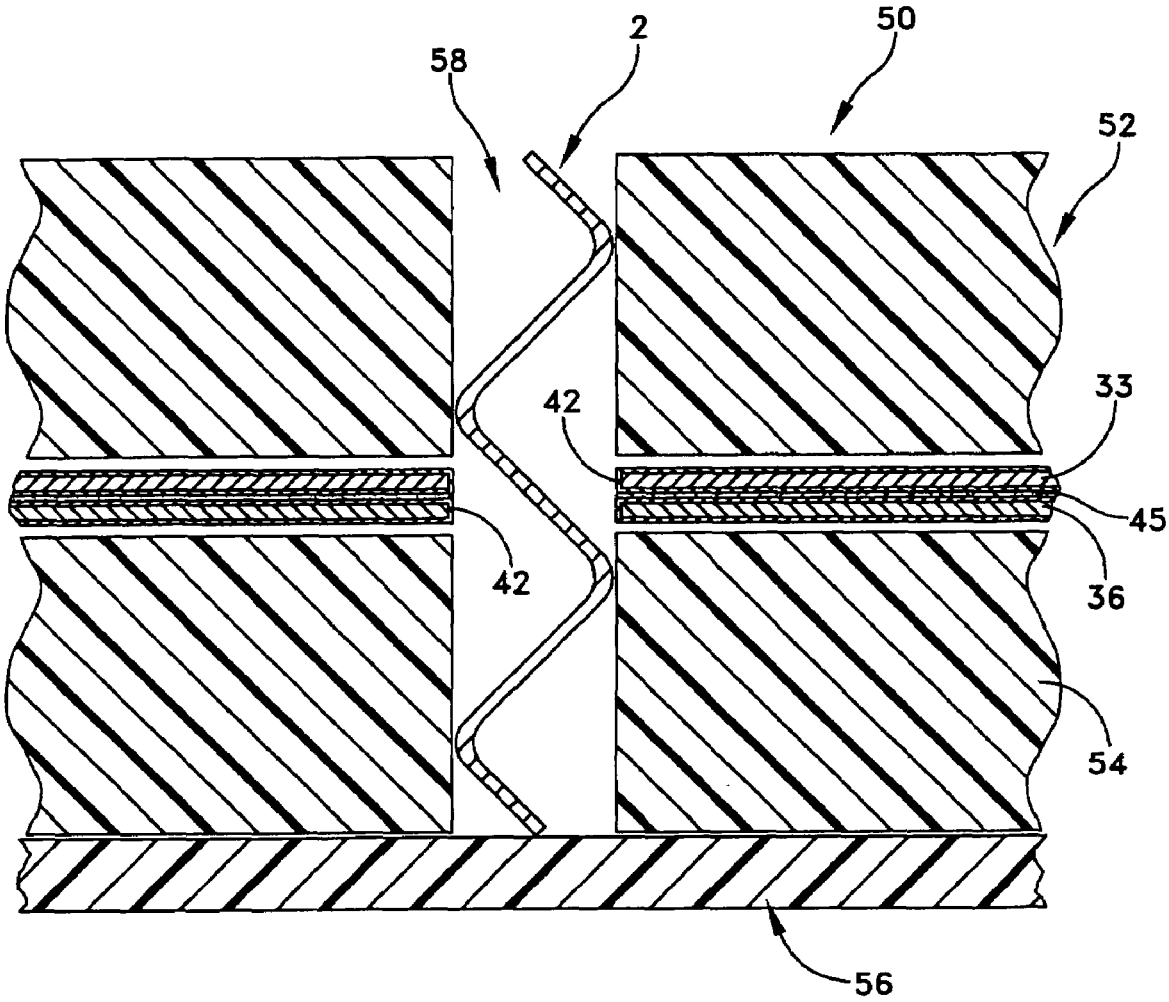
FIG. 9 is a cross-sectional view of a fully-assembled lamination stack prior to engagement of an electrical contact by a portion of a carrier assembly.
Figure 10:
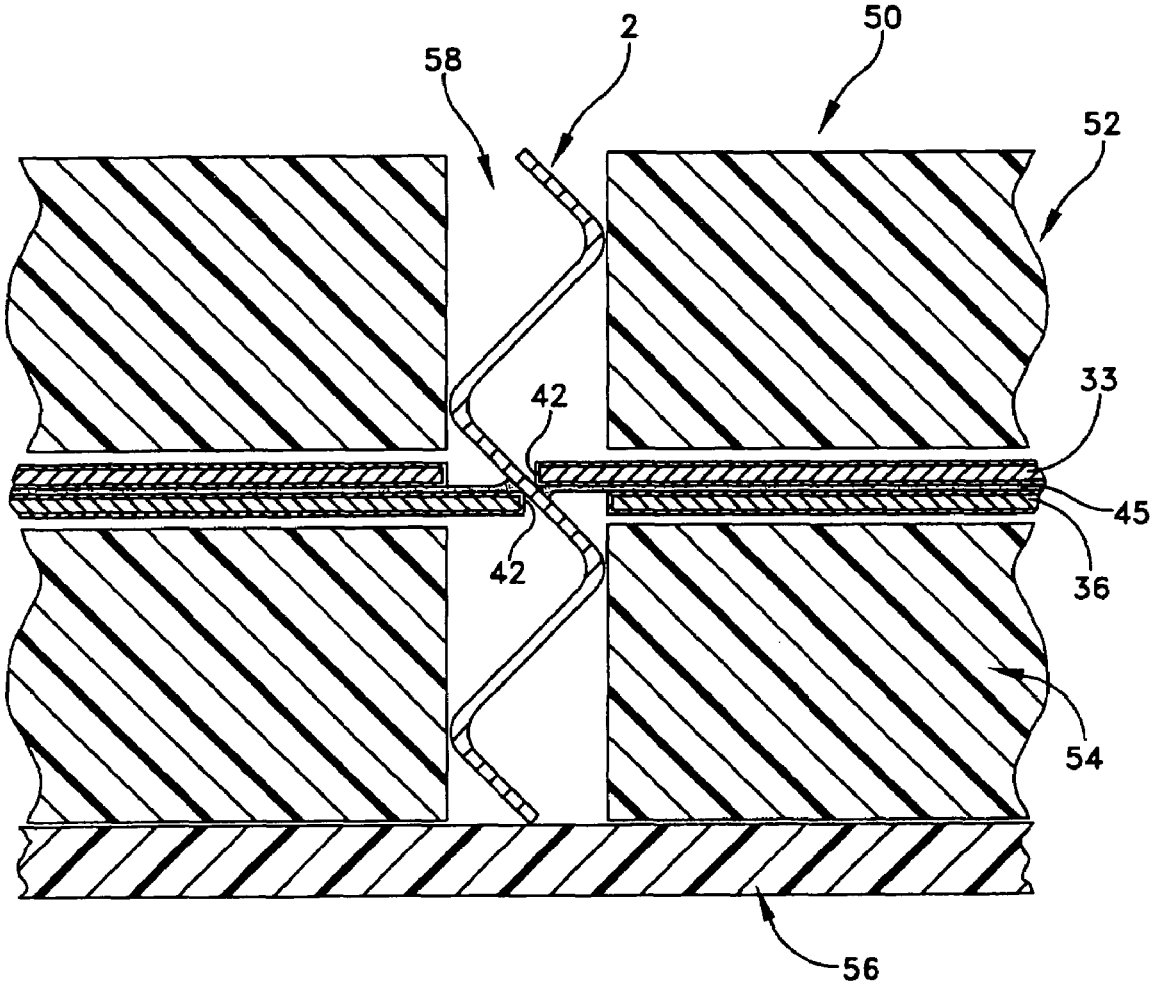
FIG. 10 is a cross-sectional view of a lamination stack similar to that of FIG. 9, but showing a carrier assembly fastened to a portion of electrical contact formed in accordance with the present invention.
Figure 11:
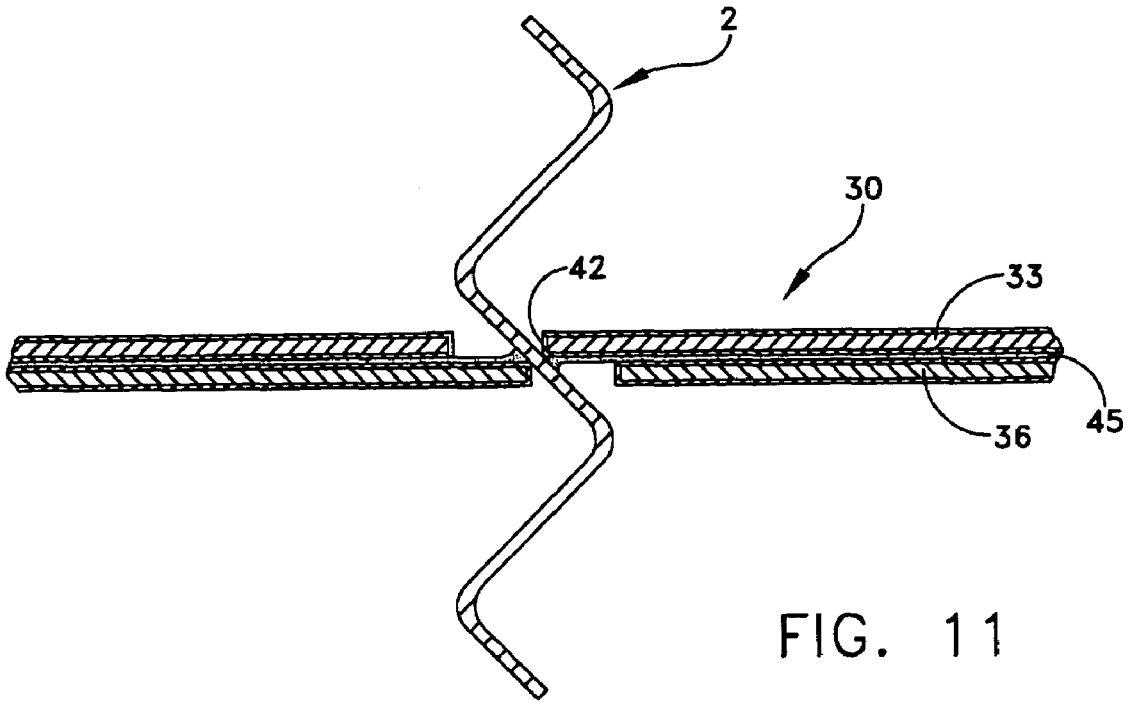
FIG. 11 is a cross-sectional view of a carrier assembly having electrical contact fixed between a top and bottom sheet.
Figure 12:
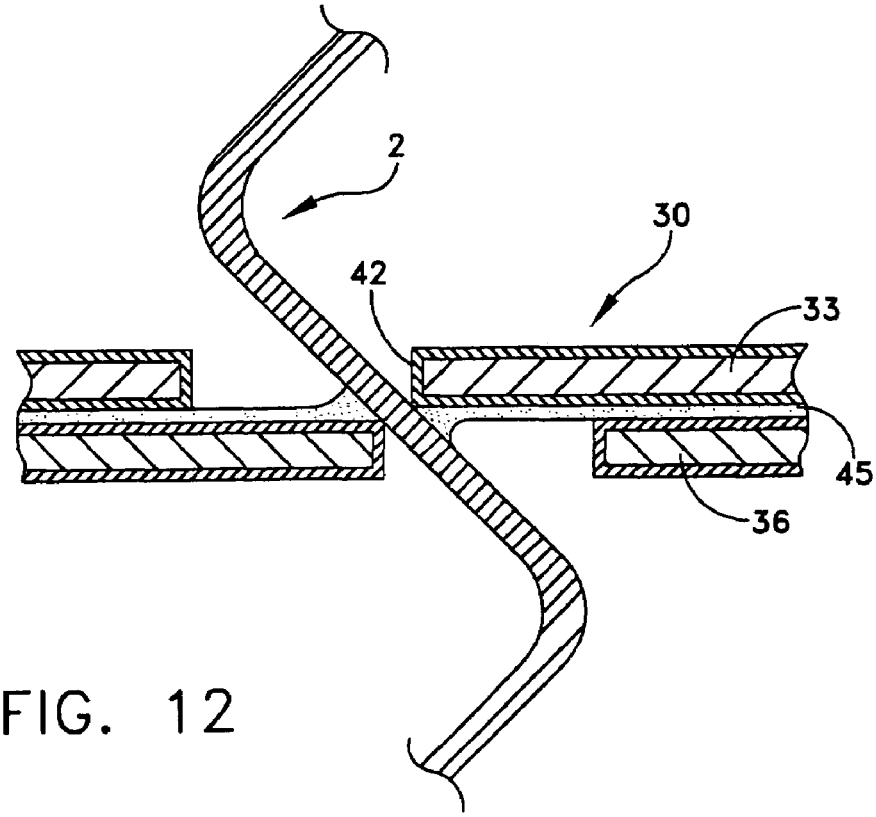
FIG. 12 is an enlarged view of the carrier assembly and electrical contact shown in FIG. 11.
Figure 13:
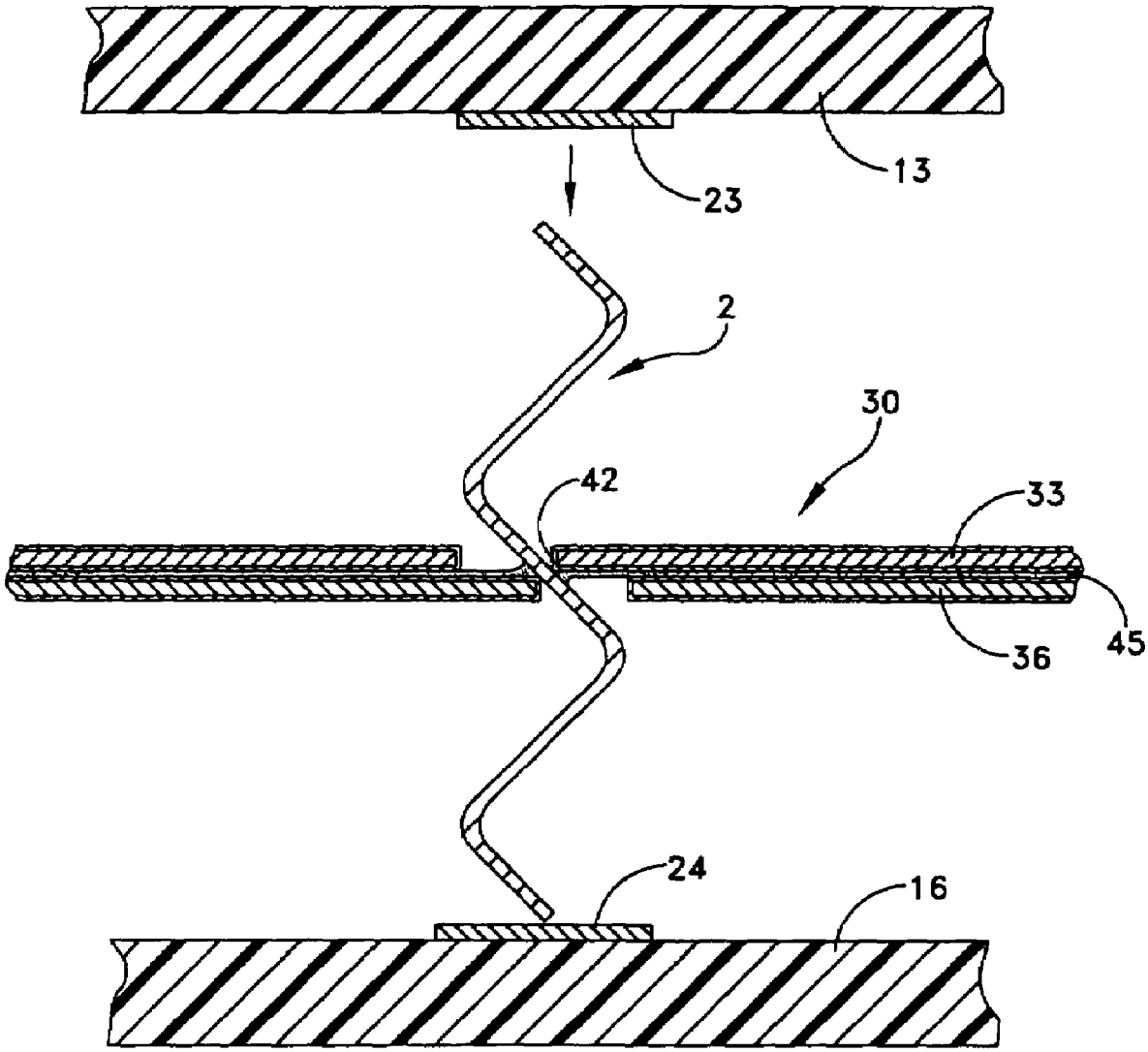
FIG. 13 is a cross-sectional view of a carrier assembly and electrical contact engaging a portion of a PCB at one end and just prior to engagement with a contact pad of an IC package at the top end.
Figure 14:
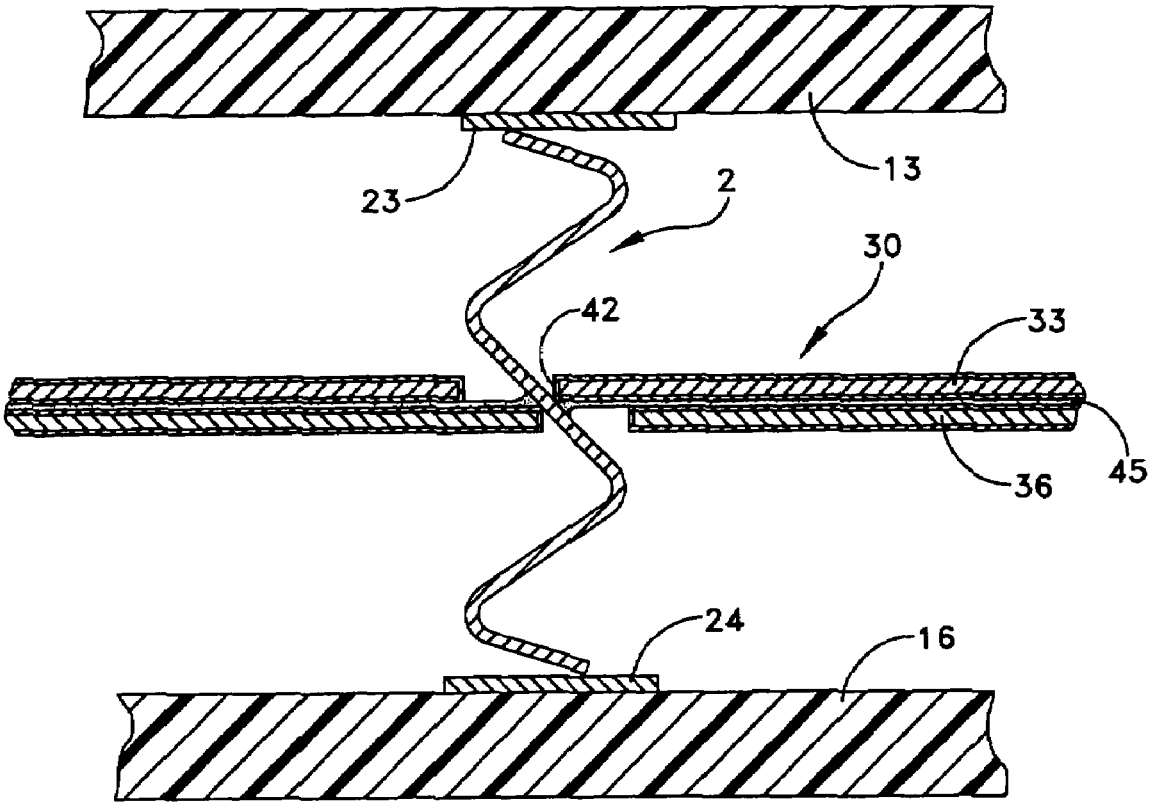
FIG. 14 is a cross-sectional view similar to that shown in FIG. 13 illustrating the engagement of an IC and printed circuit board with an electrical contact held in a carrier assembly formed in accordance with the present invention.
Figure 15:
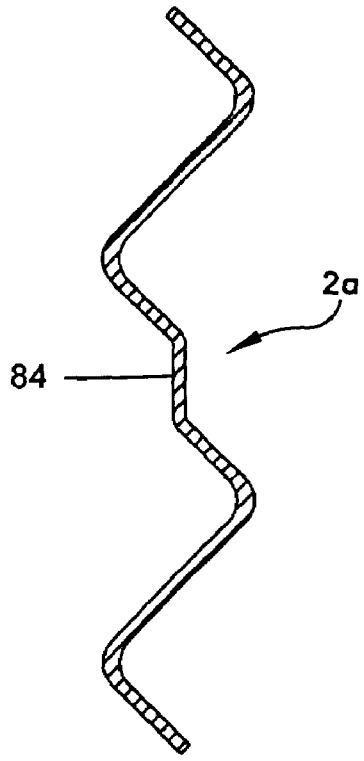
FIG. 15 is a side cross-sectional view of an alternative embodiment of electrical contact formed in accordance with the present invention.
Figure 16:
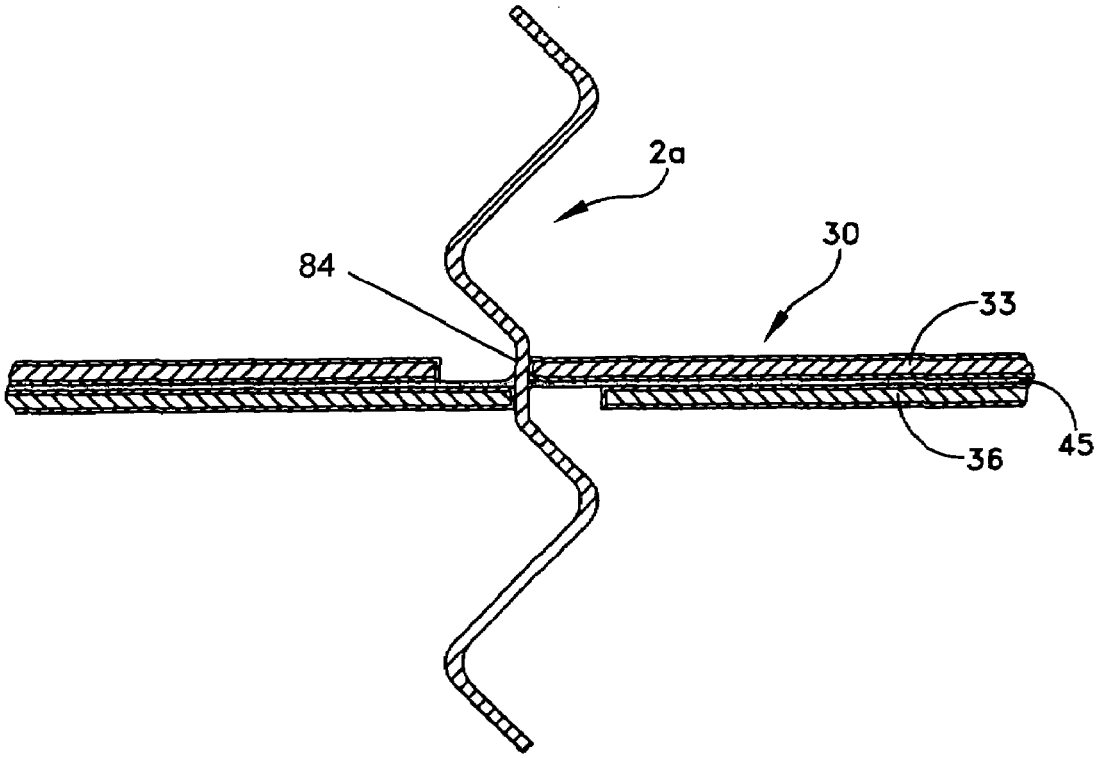
FIG. 16 is a side cross-sectional view of the electrical contact shown in FIG. 15 captured in a carrier assembly in accordance with the present invention.
Figure 17:
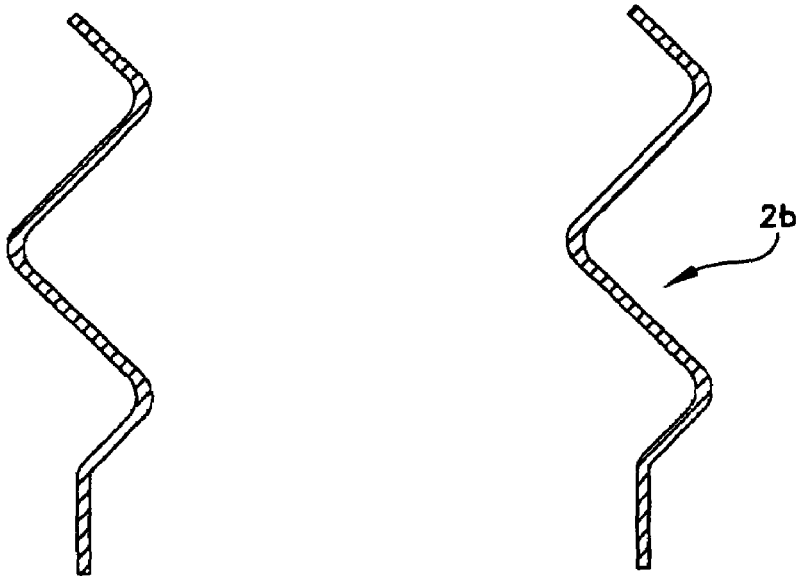
FIG. 17 is a side cross-sectional view of an electrical contact formed in accordance with another embodiment of the present invention.
Figure 18:
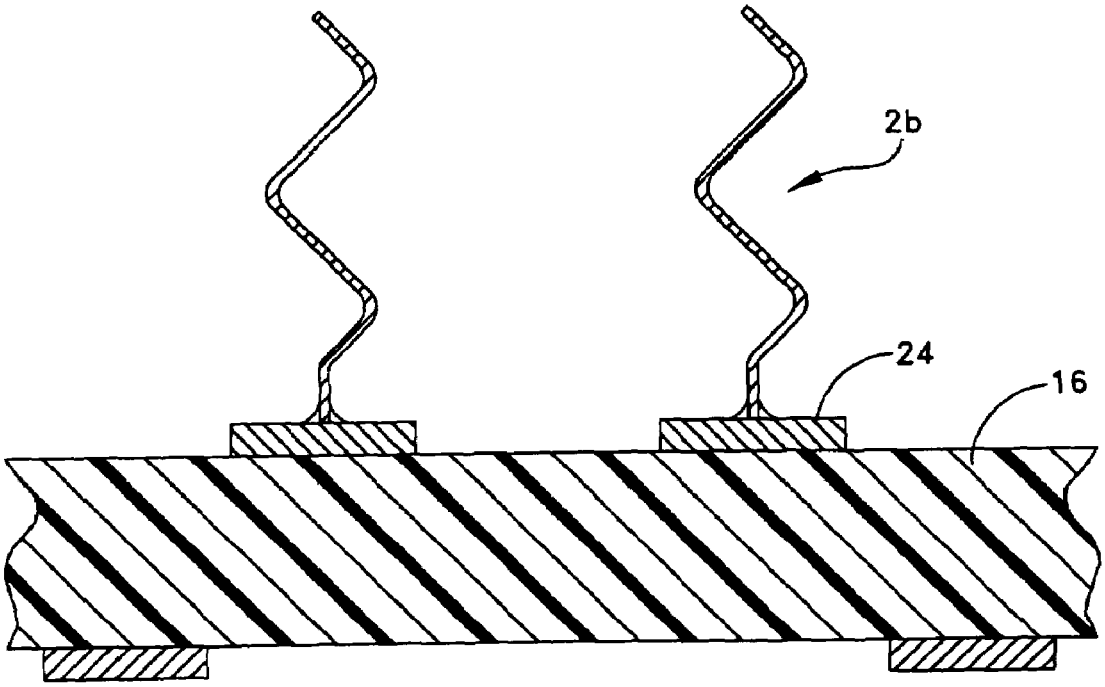
FIG. 18 is a cross-sectional view of the electrical contact shown in FIG. 17 arranged on a wafer probe card that allows for a change in contact pitch.
Figure 19:
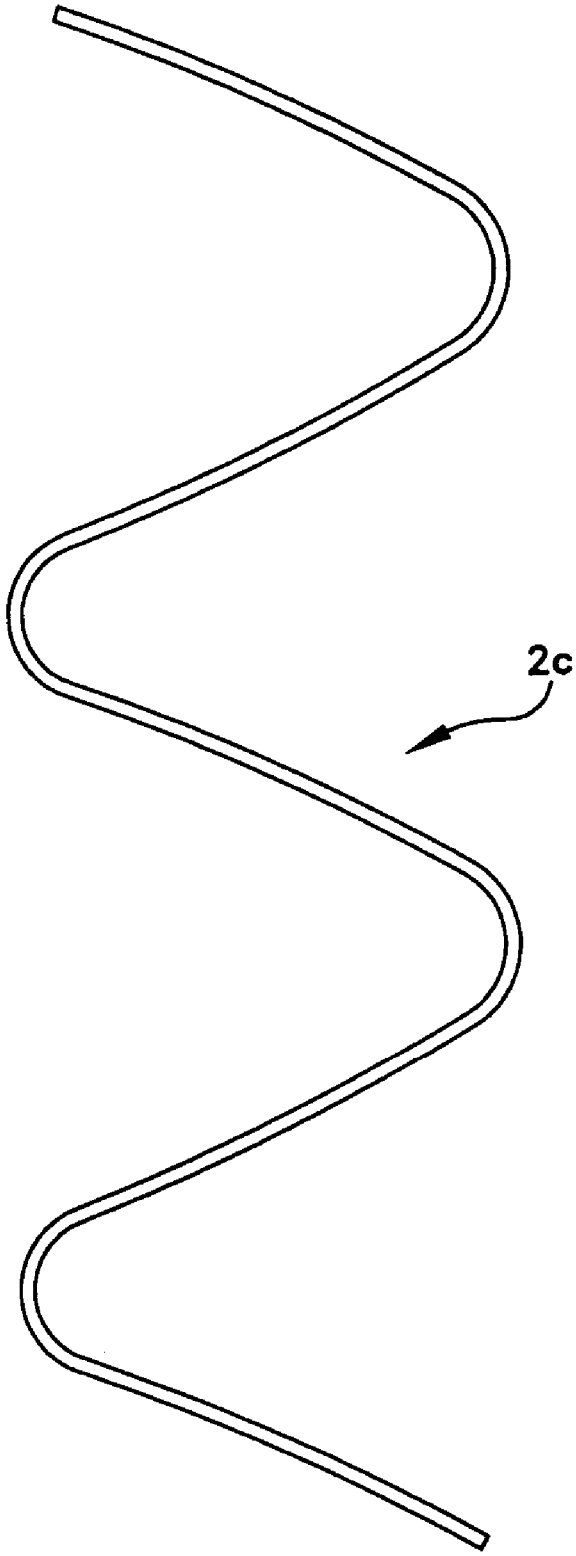
FIGS. 19-23 are cross-sectional side views of a variety of compound spring electrical contacts formed in accordance with alternative embodiments of the present invention.
Figure 20:
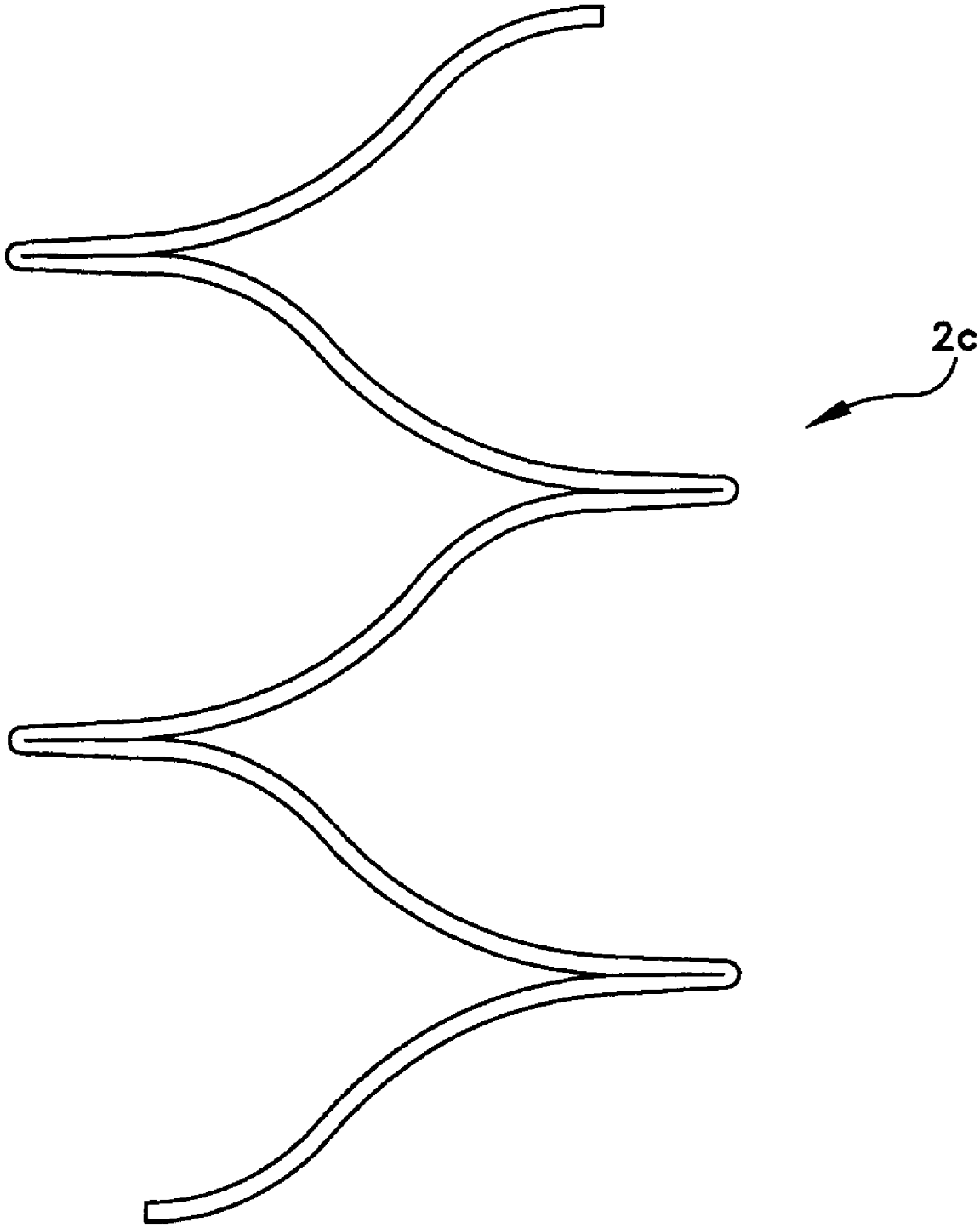
Figure 21:
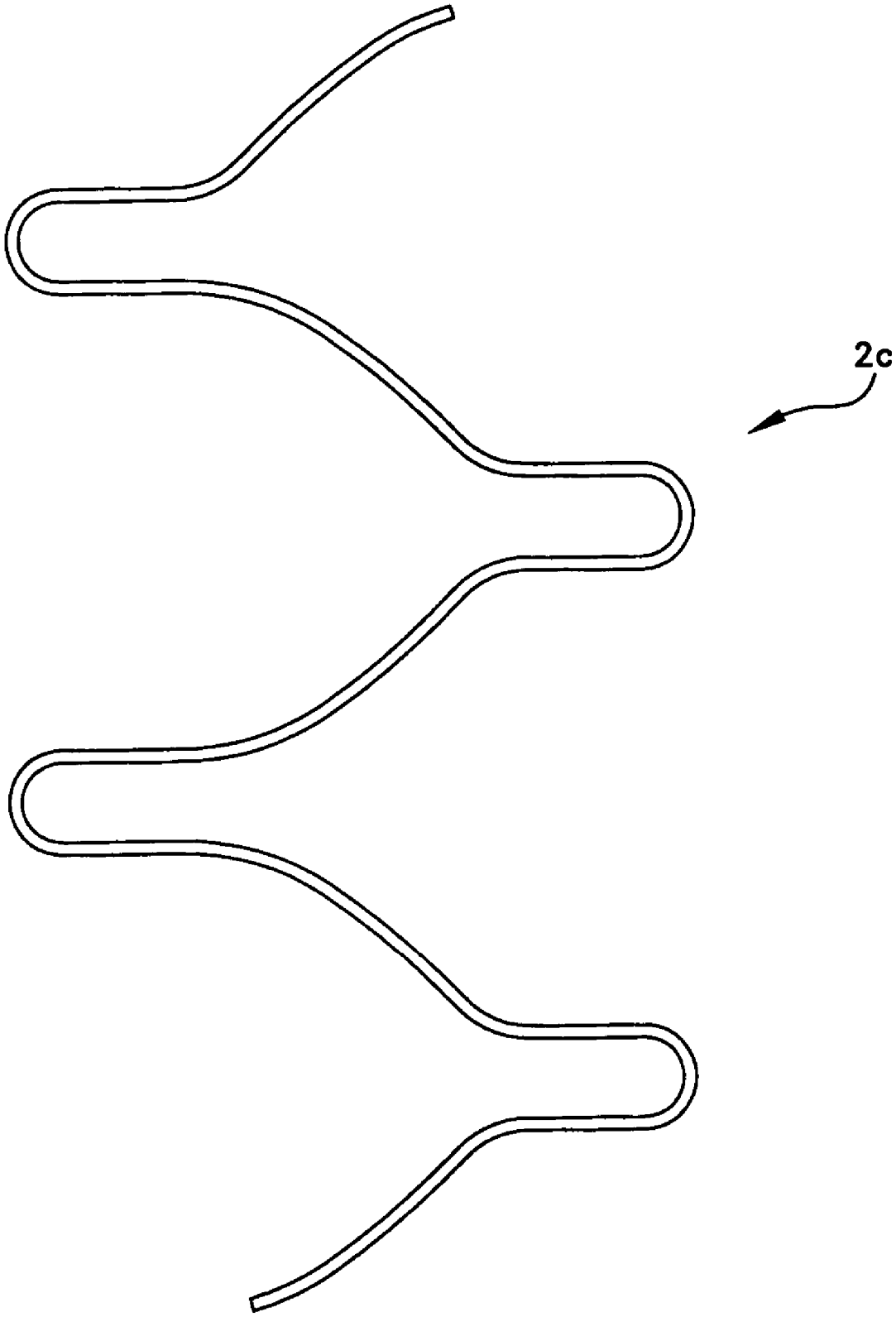
Figure 22:
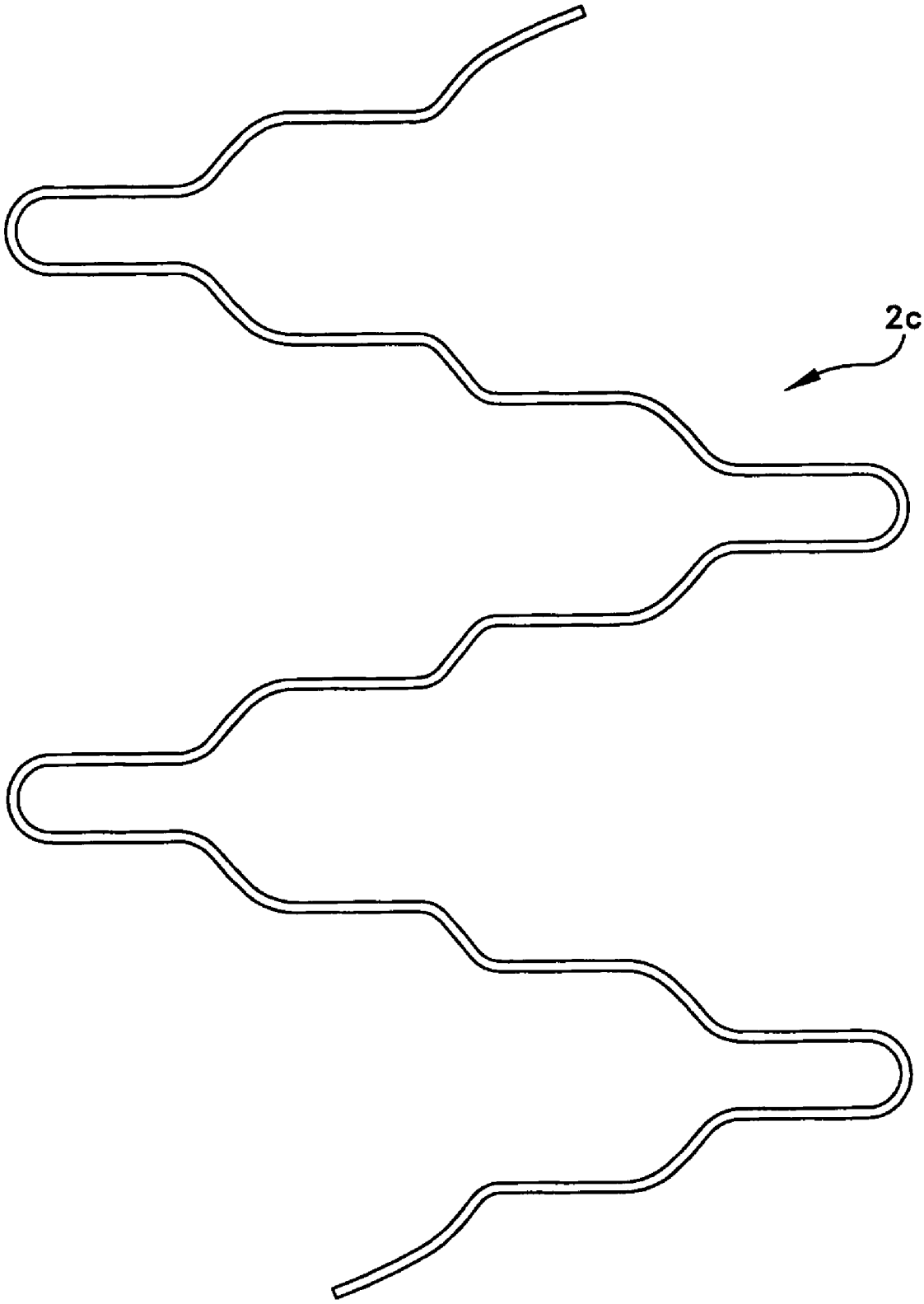
Figure 23:
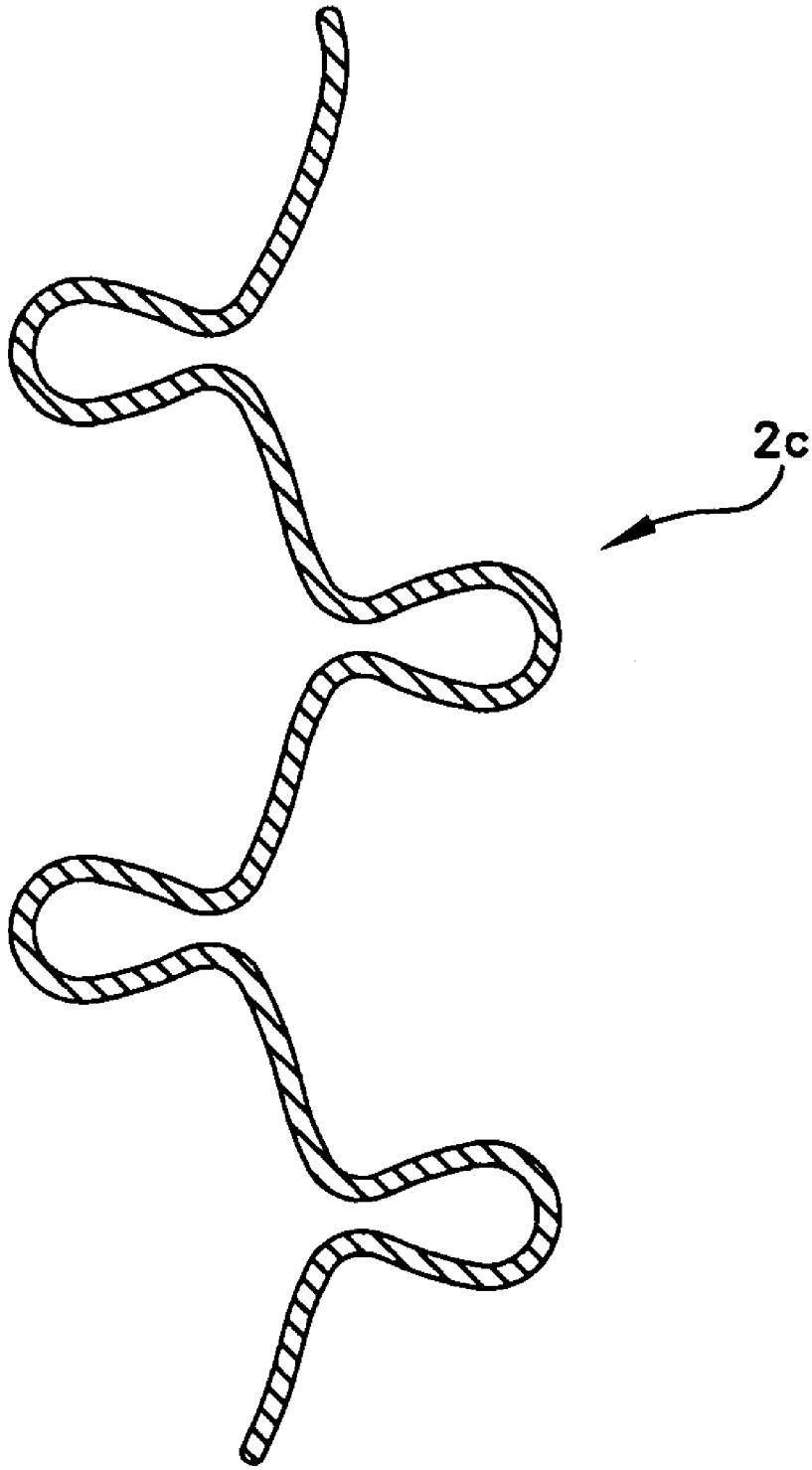
Figure 24:
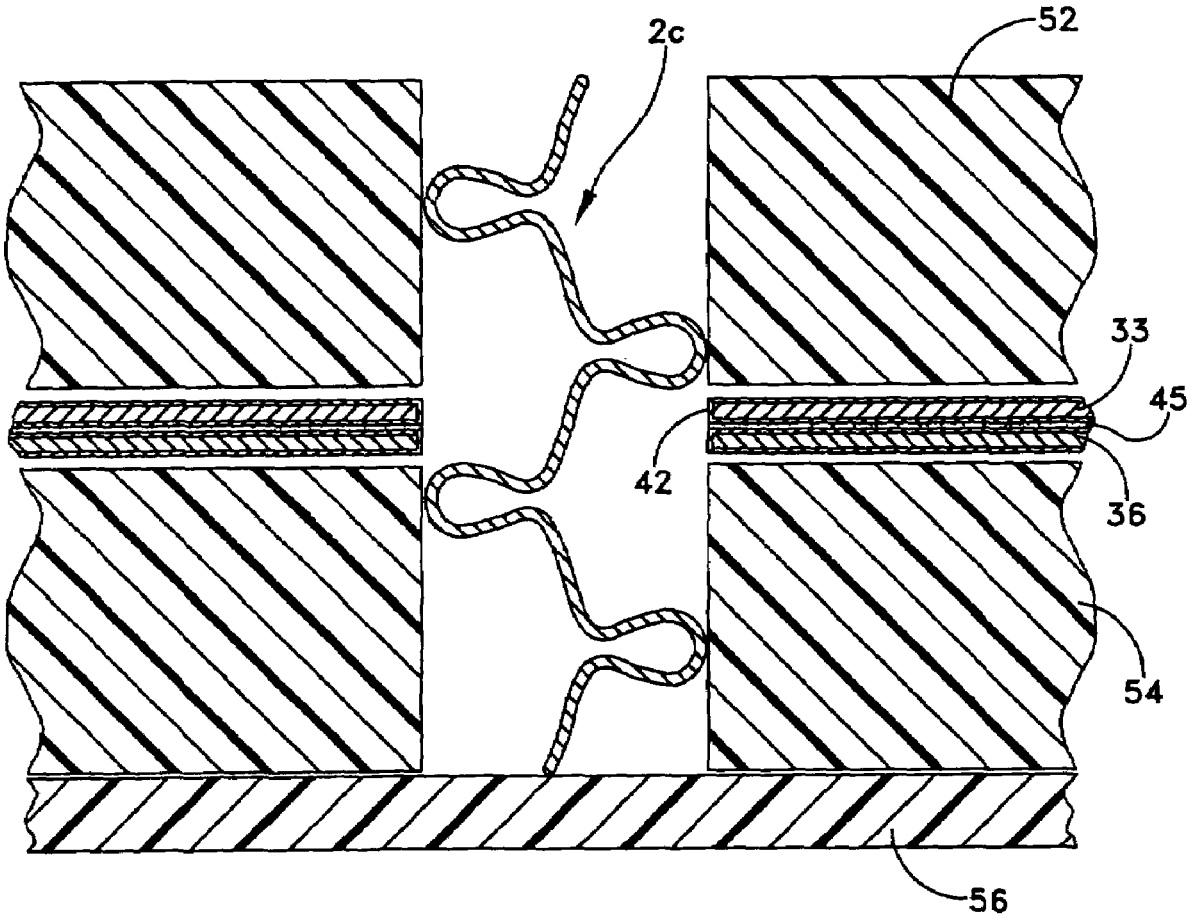
FIG. 24 is a cross-sectional view of a lamination stack including a compound spring electrical contact in accordance with an alternative embodiment of the present invention.
Figure 25:
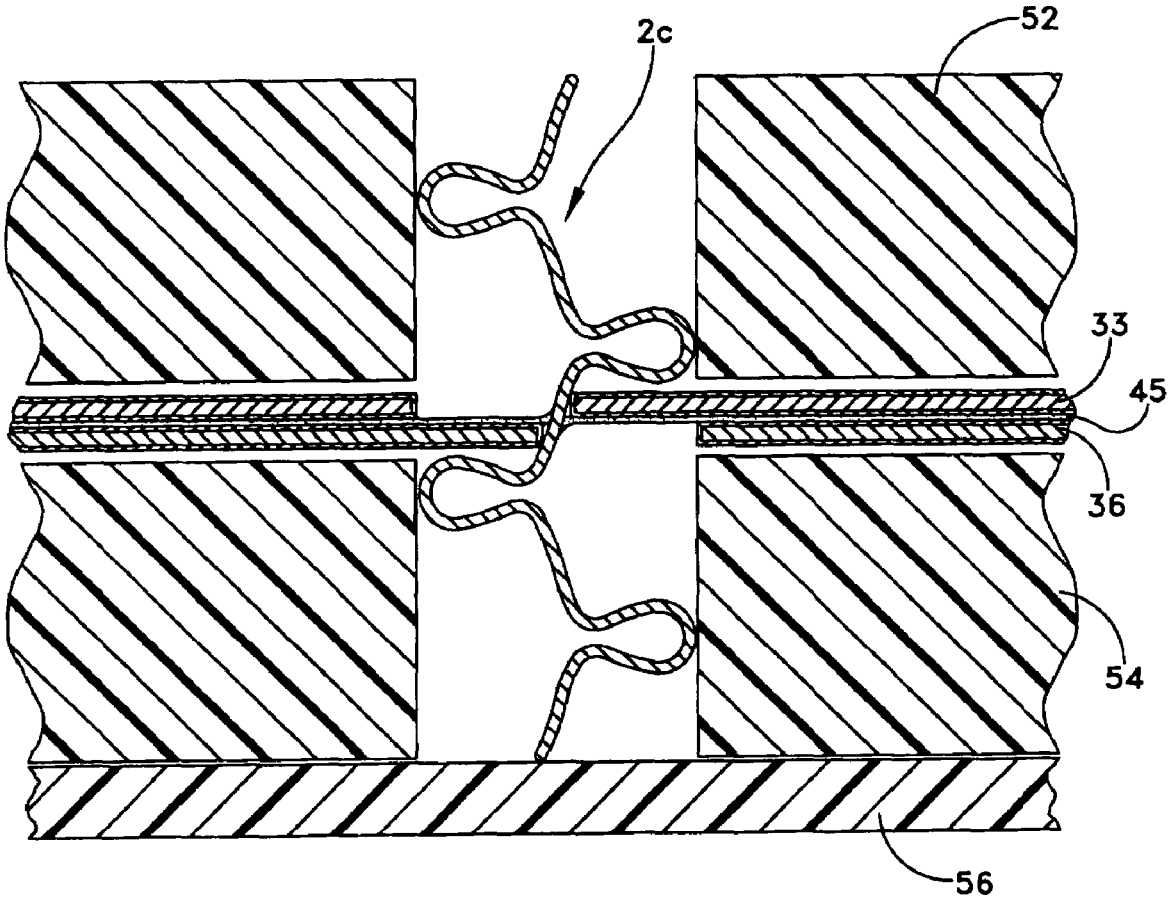
FIG. 25 is a cross-sectional view of the lamination stack and compound electrical contact shown in FIG. 24, after fixation to the top and bottom sheets of the carrier assembly.
Figure 26:
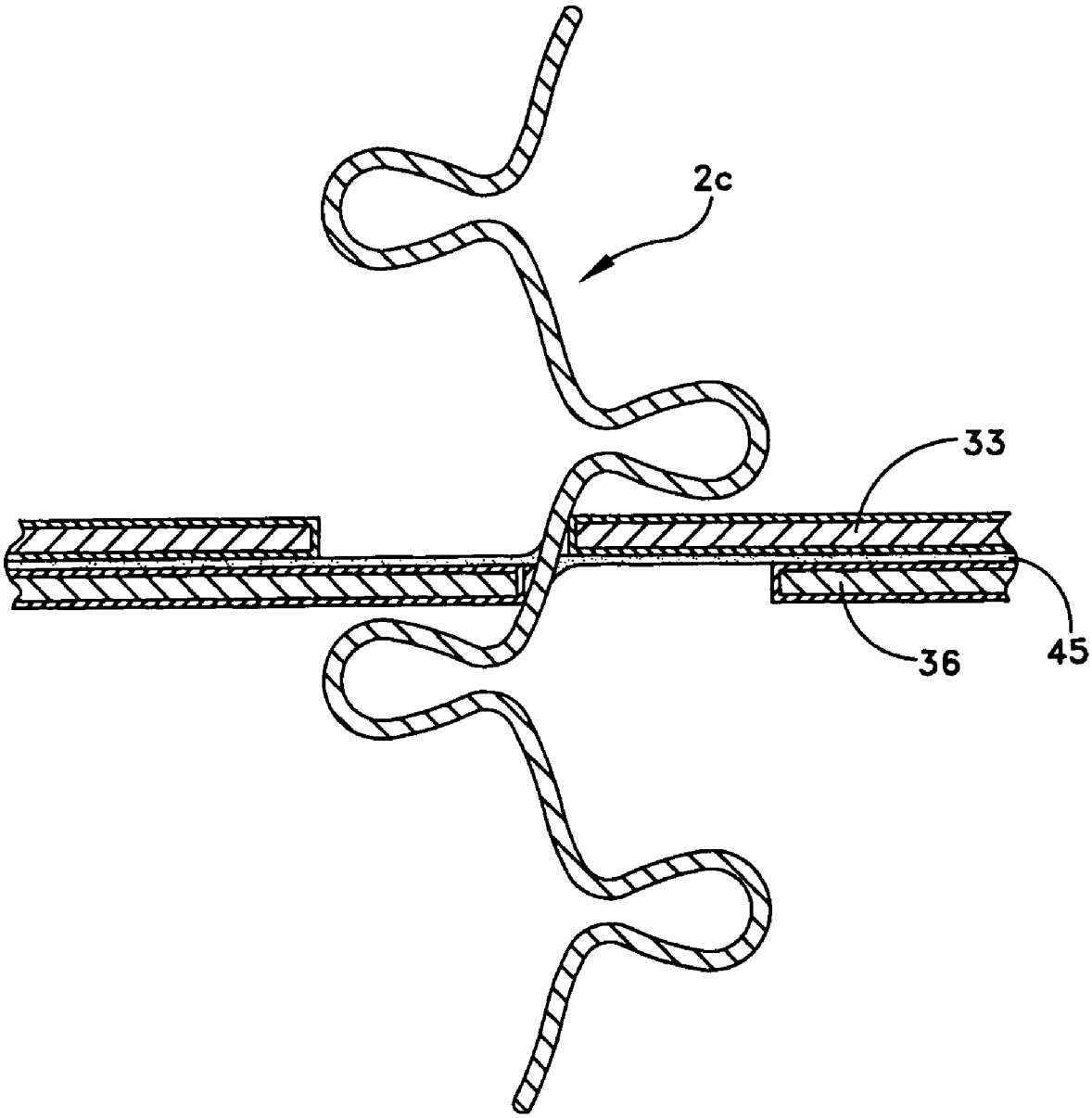
FIG. 26 is a side cross-sectional view of a compound electrical contact and carrier assembly formed in accordance with the present invention.
Figure 27:
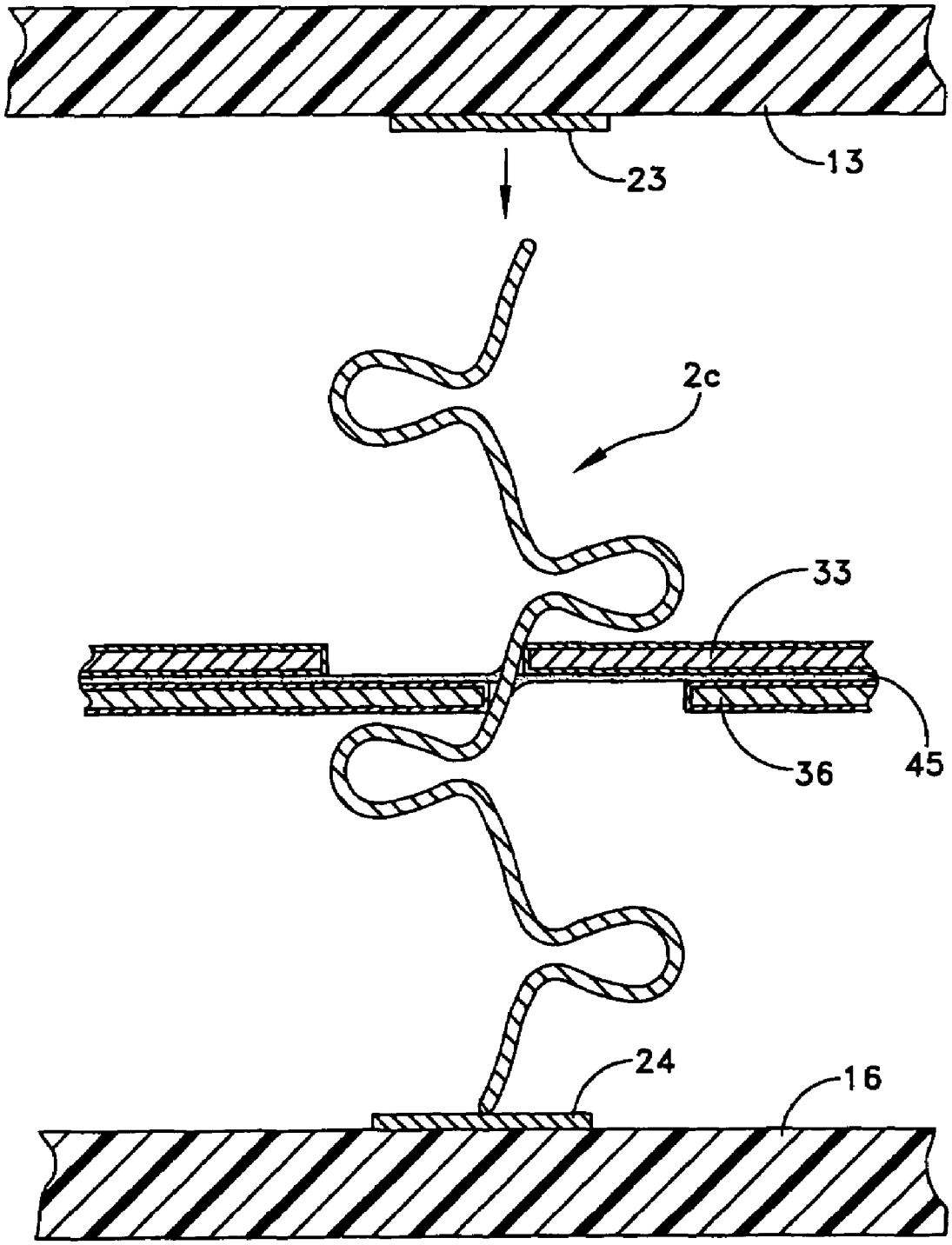
FIG. 27 is a side cross-sectional view of a compound electrical contact fastened to a carrier assembly just prior to engagement with a contact pad on an IC and a printed circuit board.
Figure 28:
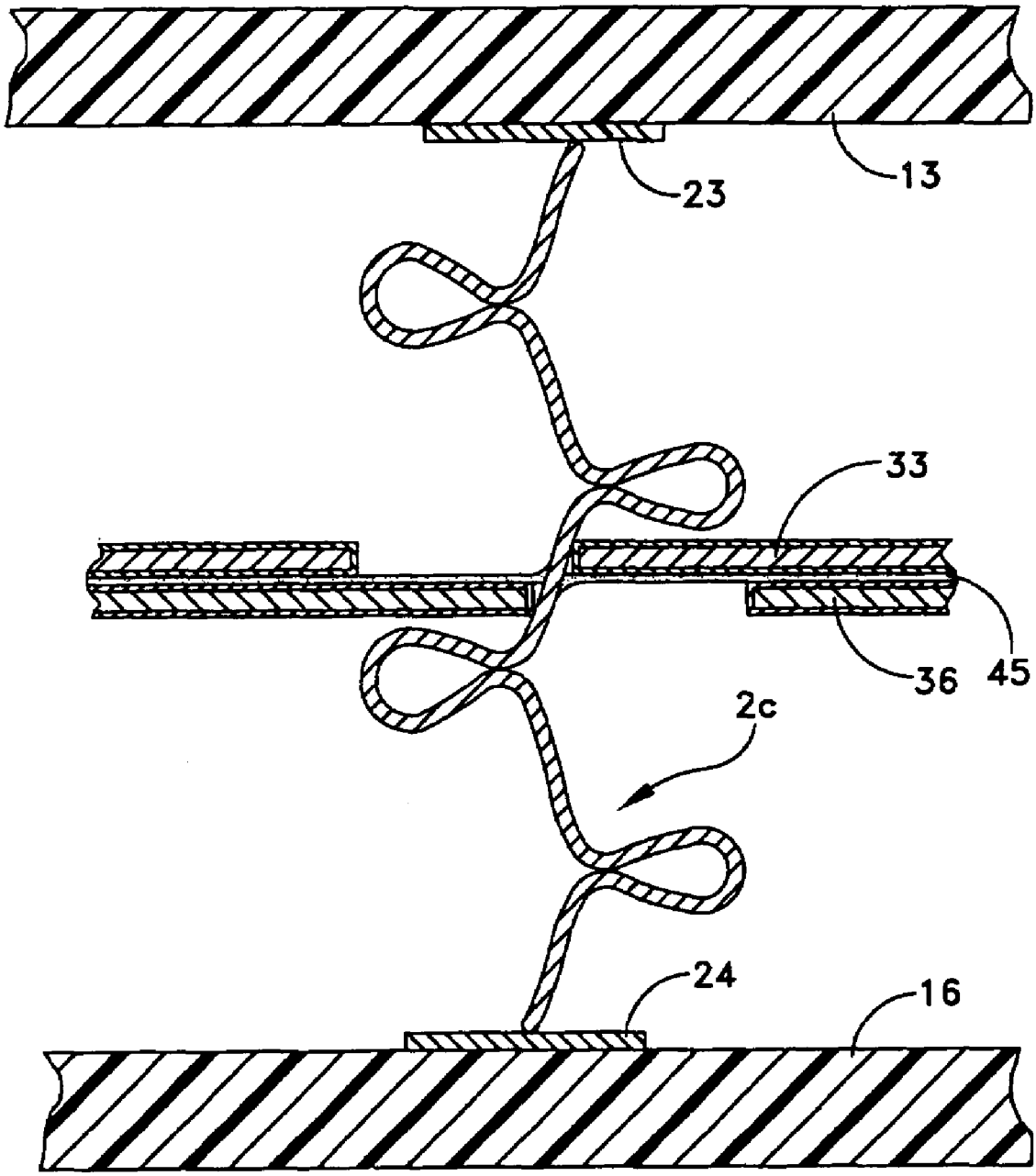
FIG. 28 is a side cross-sectional view similar to that shown in FIG. 27, illustrating a compound deflection of a compound spring electrical contact formed in accordance with the present invention.
Figure 29:
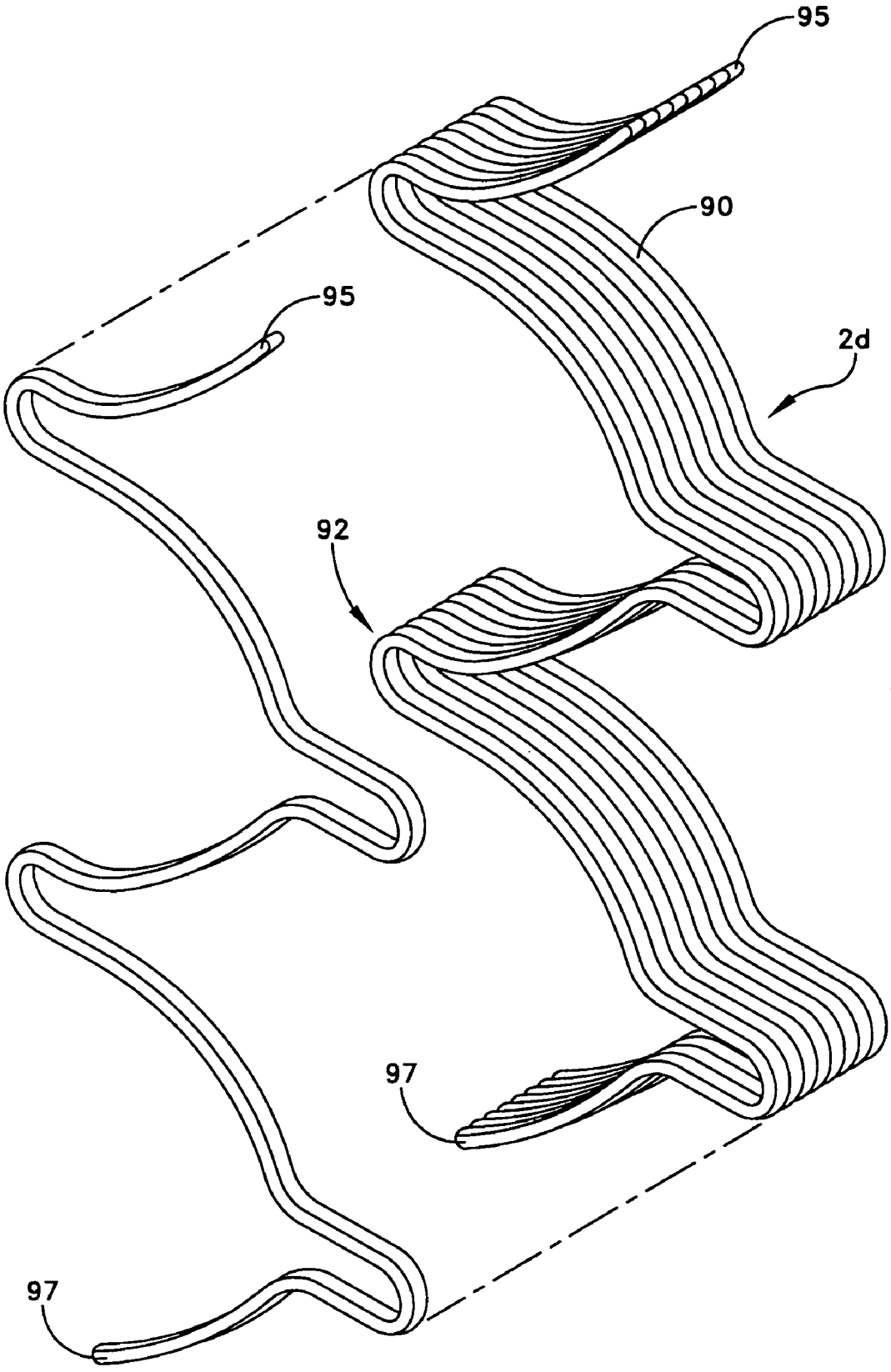
FIGS. 29-30 are perspective views of yet a further alternative embodiment of electrical contact formed in accordance with the present invention having a compound spring shape and being formed from a plurality of pre-plated wires that are adhesively fastened to one another along a common section of the contact.
Figure 30:
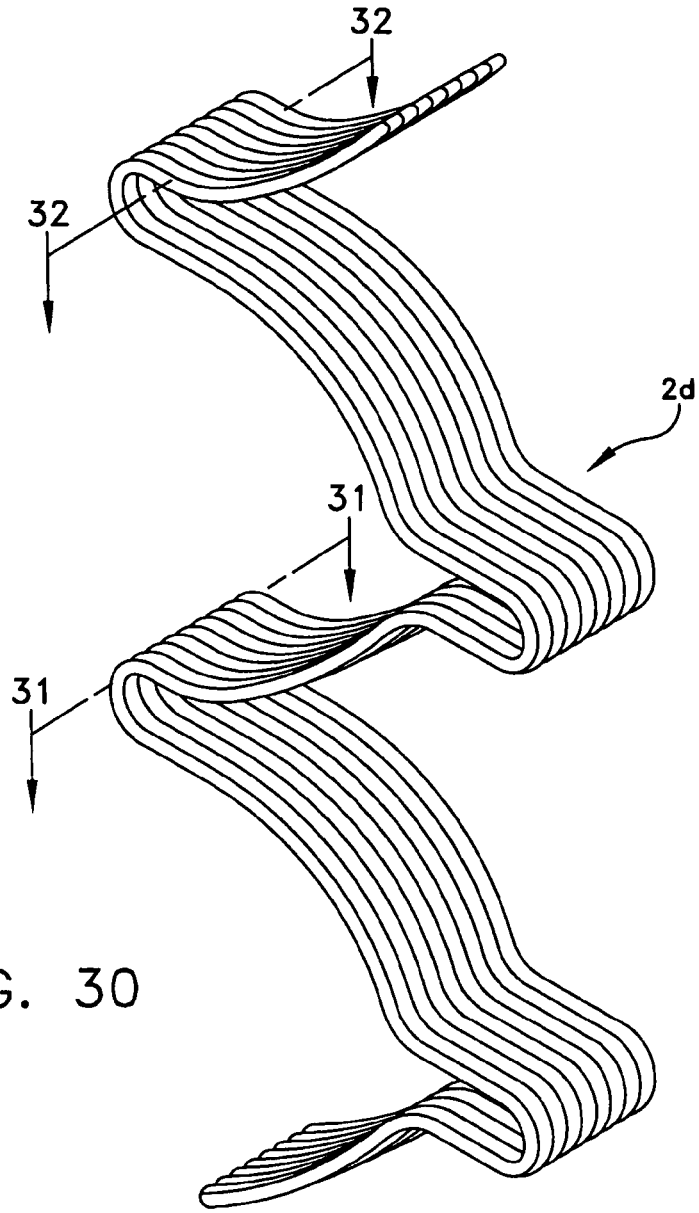
Figure 31:
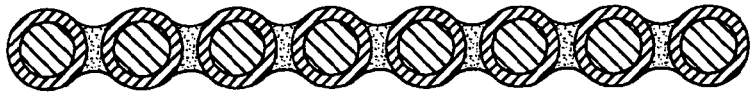
FIG. 31 is a cross-sectional view of the individual wires at an intermediate section where they are fastened to one another, as taken along the lines 31-31 in FIG. 30.
Figure 32:
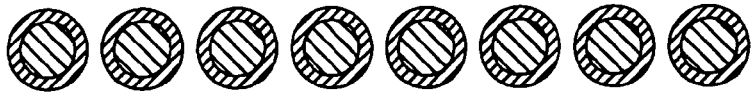
FIG. 32 is a cross-sectional view of the individual wires adjacent to a free end where the wires are free to act as individual cantilevers, as taken along the lines 32-32 in FIG. 30.
Figure 33:
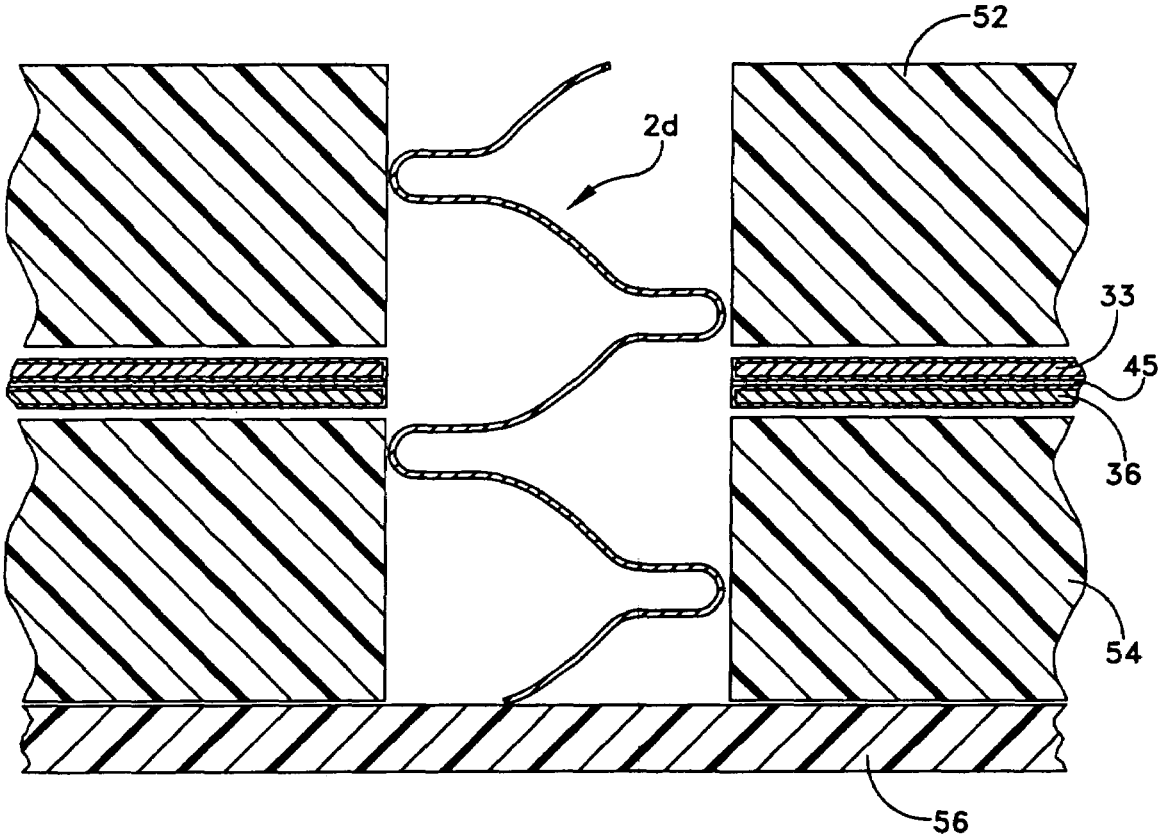
FIG. 33 is a cross-sectional view of a fully-assembled lamination stack prior to engagement of an alternative embodiment of electrical contact by a portion of a carrier assembly.
Figure 34:
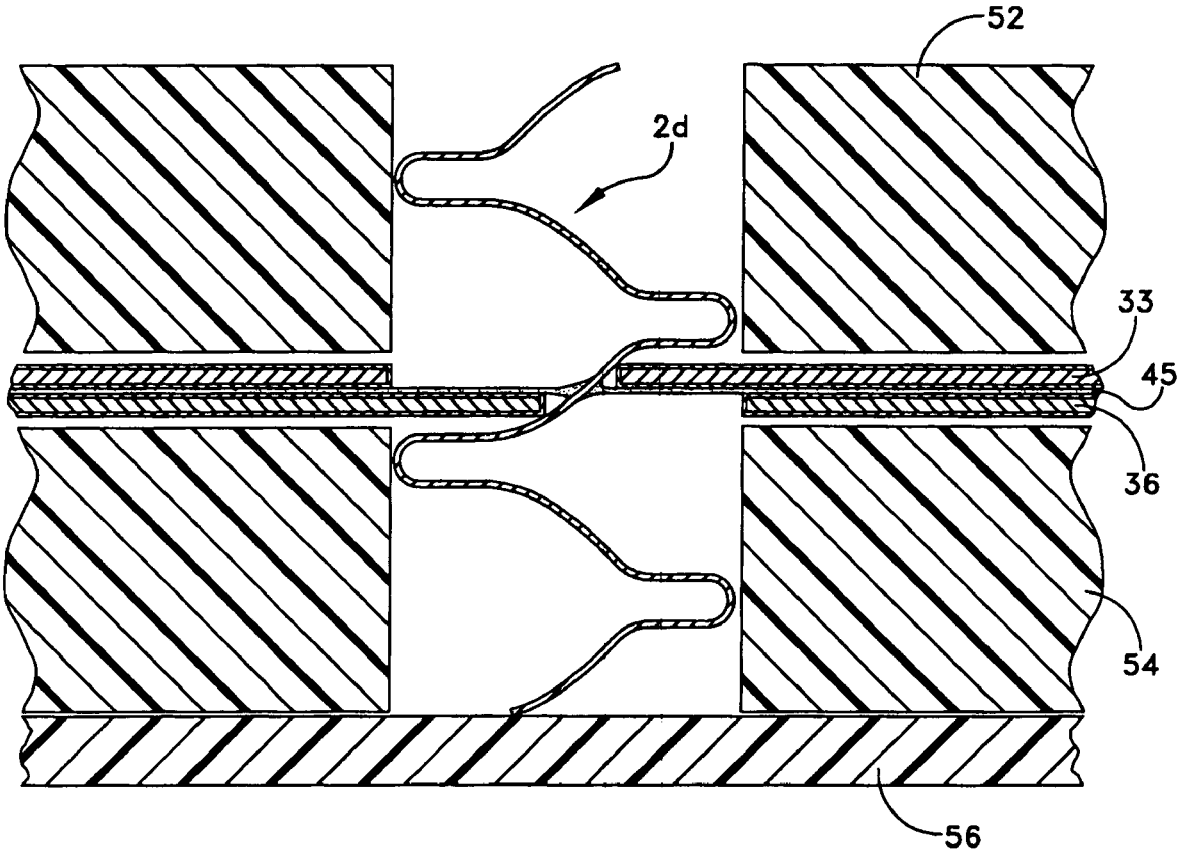
FIG. 34 is a cross-sectional view of a lamination stack similar to that of FIG. 33, but showing a carrier assembly fastened to a portion of electrical contact formed in accordance with the present invention.
Figure 35:
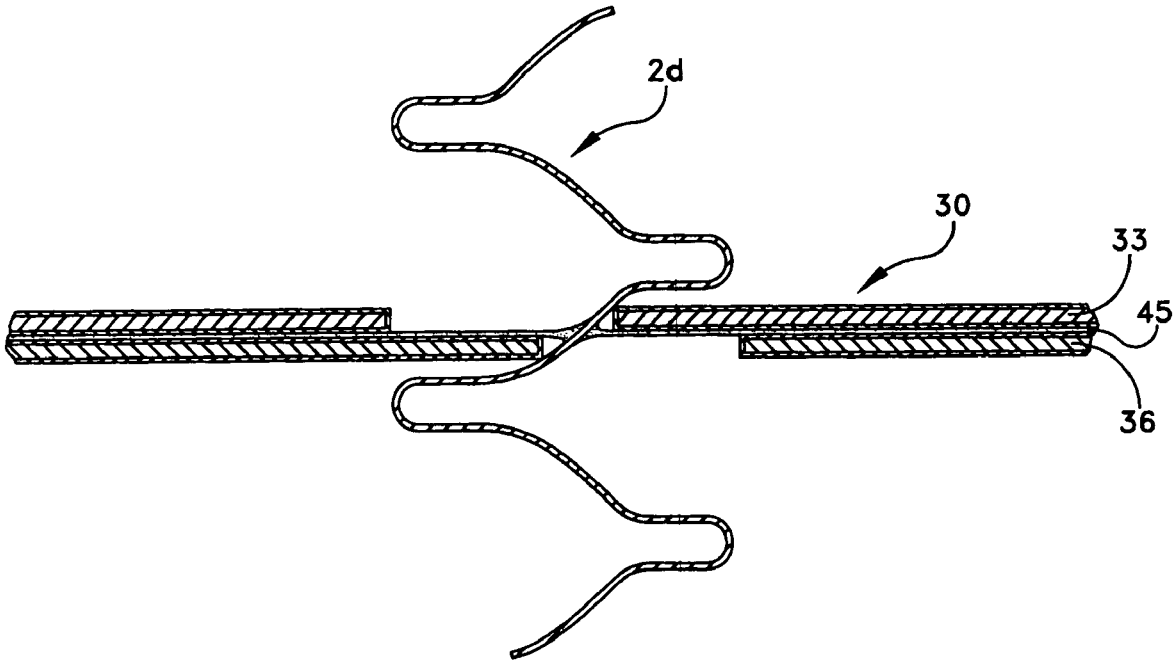
FIG. 35 is a cross-sectional view of a carrier assembly having electrical contact fixed between a top and bottom sheet.
Figure 36:
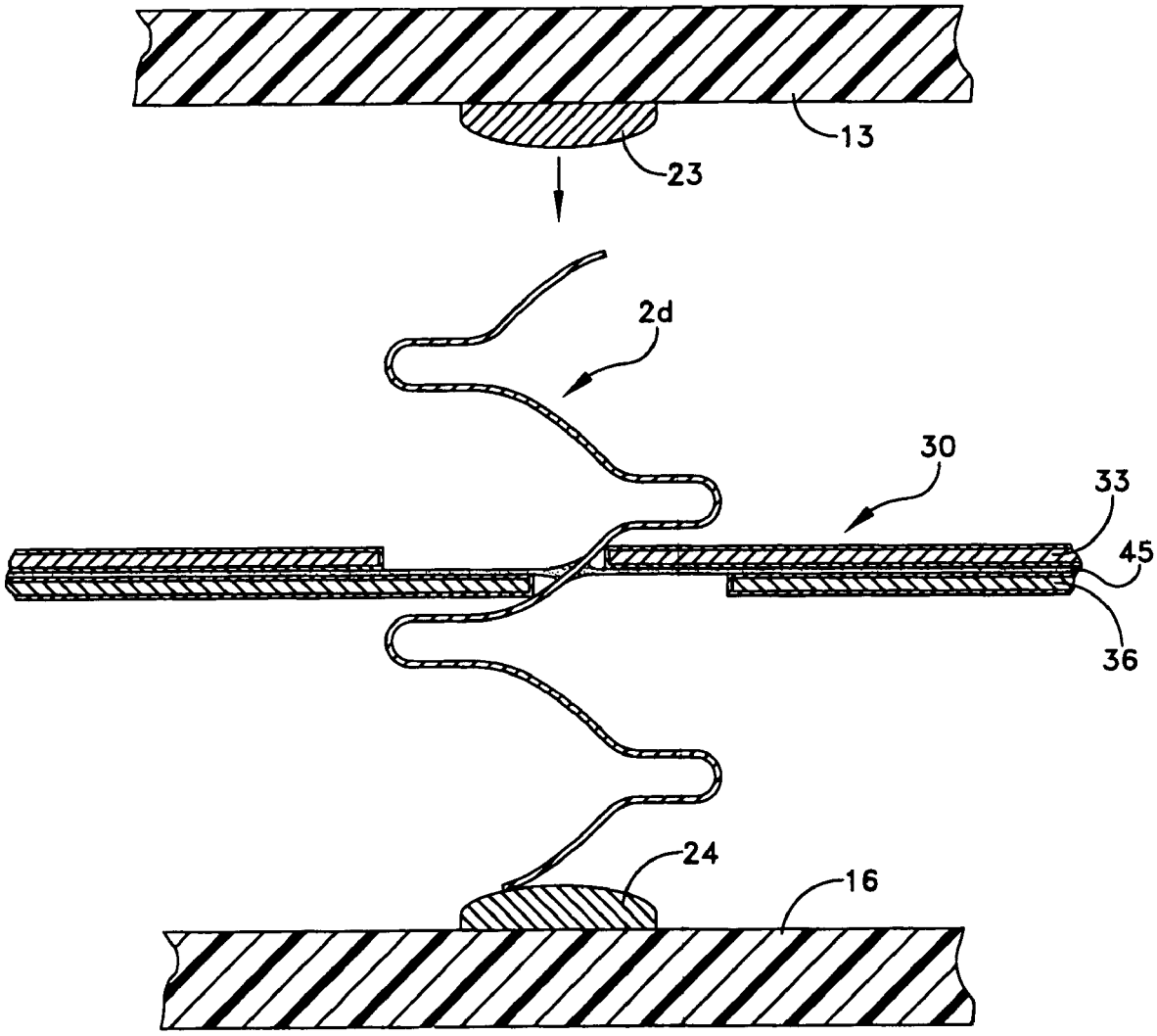
FIG. 36 is a cross-sectional view of a carrier assembly and electrical contact engaging a portion of a PCB at one end and just prior to engagement with a contact pad of an IC at the top end.
Figure 37:
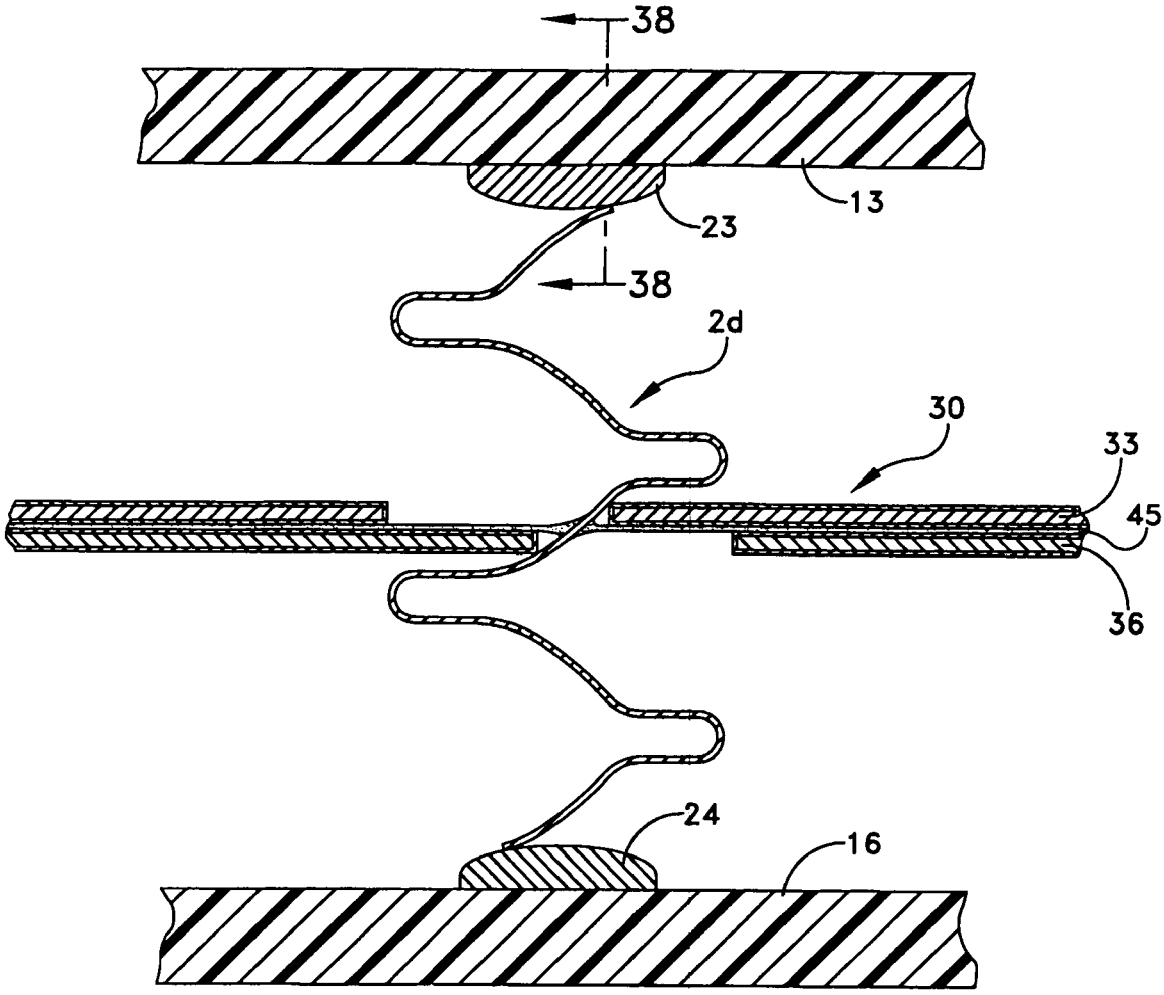
FIG. 37 is a cross-sectional view similar to that shown in FIG. 36 illustrating the engagement of an IC and printed circuit board with an electrical contact held in a carrier assembly formed in accordance with the present invention.
Figure 38:
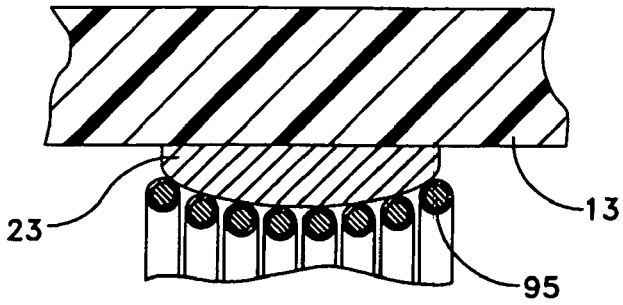
FIG. 38 is a cross-sectional view, taken along line 38-38 in FIG. 37, of a free end of the electrical contact as it engages a solder bump showing the independent deformation of each of the plurality of wires forming the electrical contact.

The plurality of longitudinally oriented corrugations may be formed in the top and bottom surfaces of base sheet 4 by etching, stamping, pressing, or skiving the surface so as to form a plurality of longitudinally oriented ridges 17 that are spaced from one another by a plurality of longitudinally oriented furrows 21 in a transverse sinusoidal pattern. Corrugated base sheet 4 is further formed, by conventional methods known in the art, into a pleat-like, folded structure (FIG. 6) having at least two transversely oriented crests 12 that represent the top surface of a fold line and that are separated by at least two transversely oriented troughs 14 that represent the bottom surface of a fold line. The terminal ends of each longitudinally oriented ridges 17 lie adjacent to top contact edge 6 and bottom contact edge 8, and provide contact pad interface regions 22. In one embodiment of the invention, electrical contact 2 comprises a thin and narrow strip of high melting temperature, high yield strength metal, such as, stainless steel, which is folded to form two or four folds, i.e. two or four creases in base sheet 4 that result from partially bending base sheet 4 along a transversely oriented line. Under a compressive load applied to either top contact edge 6 and bottom contact edge 8, each segment of the folded structure acts roughly like a bending beam to provide elastic compliance. The number of folds can be increased to increase the elastic compliance, but with a sacrifice of the resistance and inductance of the electrical contact. The root radius of each of the folds may be increased to increase compliance as well. For electrical contacts to be used to engage a solder ball, top edge 6 may be concavely curved to produce a curved contact edge so as to cradle the solder ball (FIG. 7). In this case bottom edge 8 may remain straight for contact with a flat contact pad.

In one embodiment of the invention, as many as eight to ten of longitudinally oriented ridges 17 are formed in the top and bottom surfaces of base sheet 4. This arrangement, in turn, forms eight to ten contact pad interface regions 22 that, advantageously, provide contact redundancies for better reliability through the creation of parallel conduction paths between contact pads 23, 24. Thus, longitudinally oriented ridges 17 can be viewed as several conductive wires operating in parallel to achieve the same level of conductance as that of multiple wire spring electrical contacts. This structural arrangement provides for a relatively small size (i.e., relative to the center line spacing of contact pads 23 and contact pads 24, e.g., five mils or less) with a high but adjustable elastic compliance that allows for compressive deflections of as much as thirty percent of the undeflected or uncompressed height of each electrical contact 2, and with low contact forces that are routinely less than twenty grams per electrical contact assembly.

The redundant conductor structure of electrical contacts 2 enhances and improves both a mechanical and electrical engagement between the multiple longitudinally oriented ridges 17 and contact pads 23, 24. In particular, each electrical contact 2 provides a capability for high frequency transmittance of signals greater than ten gigahertz, due to the low self-inductance created by a highly conductive short contact height. In addition, electrical contacts 2 are capable of high current capacity due to a bulk resistance that is often less than ten milliohms. The less than ten milliohms that is achieved is produced by parallel contact and bulk resistances (through longitudinally oriented ridges 17) which reduce the total resistance of the electrical interconnection by dividing a normally single, high resistance by the number of contact interface resistances that are arranged in parallel, as a result of the multiple or redundant contact pad interface regions 22 that are engaged with contact pads 23, 24.

In one embodiment, a folded beam electrical contact 2 has two folds, where the two beam segments 26 that terminate along top contact edge 6 and bottom contact edge 8 of electrical contact 2 have only one-half the length of the long segments 28. This construction provides a contact point in the center of the folded structure. Alternatively, four folds can be provided with two short beam segments 26 and three long segments 28 located between them. The fold angle is a variable that determines the height and elastic compliance of the folded structure when the later is compressed along the longitudinal axis of the structure from either top contact edge 6 or bottom contact edge 8. Vacuum-melted 304 stainless steel may be rolled into a fully hardened sheet 18 of a required thickness, in the range from about 0.5 mils to about 1.5 mils. The fully hardened state is preferred so as to achieve a high yield strength providing a high fatigue strength especially when formed into thin cross-section sheets, on the order of one mil or less. Of course, other stainless steel alloys or other high melting temperature and high yield strength nonferrous alloys may be used with adequate results.

A folded electrical contact 2 may be formed in accordance with the present invention by first cutting a plated or clad base sheet 4 into narrow strips, e.g., having widths of from two mil to about three mils for center line spacing of five mils. Often, the width of the narrow strips is in the range from about five to ten times the thickness of base sheet 4. The thickness of the conductive metal cladding or plating is typically ten to forty percent of the thickness of a stainless steel sheet 18, often in the range from about 0.5 mils to 1.5 mils. After cutting, the cut sides of the narrow strip are often not covered by the conductive metal cladding or plating. Alternatively, the conductive metal can be applied to the narrow strips after cutting to cover all its sides. The narrow strips are then folded by using conventional CNC spring making machines or their equivalent, in high volume.

In one example of the present invention, an electrical contact is formed from vacuum melted stainless steel with a cross-section of 1.5 mils by fifteen-mils and a gold cladding of 0.3 to 0.4 mils thickness. Short beam segments 26 have a length of 7.5-10-mils and three long segments 28 have a length of 15-20-mil. Such an electrical contact 2 is capable of more than a ten mil elastic compliance under a contact force of less than thirty gram load, and a resistance of about ten milliohms or less. The elastic compliance can be increased when the number of folds is increased to four with a doubling of bulk resistance of the electrical contact. For chip or wafer level contact or interconnection a folded beam electrical contact 2 having two or four folds, a cross-section of 0.5 mils×three mils, a gold cladding of 0.1-0.15 mils thick, a short segment 26 of 2.5-mils length, and long segments 28 of 5-mils length, have been found to provide adequate compliance and electrical performance.

Referring to FIGS. 8-12, 16, and 24-26, each electrical contact 2 is supported within a carrier assembly 30 that includes a top sheet 33 and a bottom sheet 36. Top sheet 33 and bottom sheet 36 are often formed from an insulator coated metal, a rigid polymer, or a polymer composite, i.e., an insulator coated steel or one of the many copper alloys known in the art, e.g., brass, phosphor bronze, etc., or formed from a rigid polymer or polymer composite, such as polyamide, epoxy/glass composite, etc. In addition, a ceramic coating may form the surface insulator of top sheet 33 and bottom sheet 36 in place of a polymer insulator. An array of through-holes 40 are either pierced or chemically etched through top sheet 33 and bottom sheet 36, and sized, shaped, and arranged so as to correspond to the pattern of contact pads 23 located on the bottom surface of IC package 13 and also to the pattern of contact pads 24 that are located on either the top or bottom surface of PCB 16. Means for securely mounting carrier assembly 30 to PCB 16 are also provided, and indicated generally at reference numeral 25. Through-holes 40 are often rectangular in shape to fit the outline of electrical contact 2. Each of top sheet 33 and bottom sheet 36 is encased by a polymer, e.g., a polyamide, including the edges 42 of each of top sheet 33 and bottom sheet 36 that define each through-hole 40. An inactivated layer of adhesive 45 is applied to either the top surface of bottom sheet 36 or the bottom surface top sheet 33, and particularly prominently along edges 42. Top sheet 33 is then placed on top of bottom sheet 36, with inactivated adhesive layer 45 disposed between them so that top sheet 33 and bottom sheet 36 can slide over one another. In this construction, through-holes 40 in top sheet 33 are initially arranged in coaxially aligned relation to through-holes 40 in bottom sheet 36. However, when top sheet 33 is slid relative to bottom sheet 36, edges 42 that define through-holes 40 move toward one another so as to narrow the size of through-holes 40.

Electrical contacts 2 are mounted to carrier assembly 30 as follow. Fixture 50 is formed including a top lamination stack 52, a bottom lamination stack 54, and a contact stop plate 56 (FIGS. 8-12). Top lamination stack 52 and bottom lamination stack 54 are often formed from a series of rigid plates (e.g., steel) that each have an array of through-holes 58 that are sized, shaped, and arranged so as to correspond to the pattern of through-holes 40 in carrier assembly 30. Stop plate 56 has no holes and is positioned under bottom lamination stack 54 so as to close off each of through-holes 40. A carrier assembly 30 is positioned between top lamination stack 52 and bottom lamination stack 54 so that each of through-holes 40 is arranged in coaxially aligned relation to a corresponding one of through-holes 58.

Once in this position, an electrical contact 2 is positioned in each of through-holes 40, 58 so that bottom contact edge 8 abuts a portion of the surface of contact stop plate 56. From this arrangement, top sheet 33 is slid relative to bottom sheet 36, so that edges move toward one another and toward the top and bottom surfaces of electrical contact 2 while narrowing the size of through-holes 40. Once edges 42 engage electrical contact 2, the inactivated adhesive 45 that is resident along edges 42 contacts a portion of electrical contact 2. The lamination stack, under a compressive load, holds the array of electrical contacts 2 positioned in carrier assembly 30, which is then placed in an oven so as to activate and cure adhesive 45. Once the curing process is complete, the lamination stack is removed from its surrounding relation with electrical contacts 2 and carrier assembly 30 so as to release an electrical interconnection device or interposer 1 comprising a plurality of electrical contacts that are arranged so as to stand proud of the top and bottom surfaces of top sheet 33 and bottom sheet 36.

Referring to FIGS. 2, 13-14, 27-28, and 36-37, an IC package 13 may be electrically interconnected with a printed wiring board 16 using electrical interconnection device1 populated with electrical contacts 2 of the present invention. More particularly, with a plurality of electrical contacts 2 positioned projecting outwardly from carrier assembly 30, electrical interconnection device1 may be positioned between the bottom surface of IC 13 and a top or bottom surface of printed wiring board 16. In this arrangement, contact pads 23 of IC package 13 are positioned in confronting relation to top contact edge 6 and eight to ten contact pad interface regions 22. The eight to ten contact pad interface regions 22 advantageously provide contact redundancies for better reliability through the creation of parallel conduction paths between contact pads 23. Once in this position, carrier assembly 30 may be moved toward printed wiring board 16 such that cantilevered arms bottom contact edge 8 with its eight to ten contact pad interface regions 22 make electrical and mechanical contact and engagement with the top surfaces of each of contact pads 24. It will be understood that the off-set nature of top edge 6 and bottom edge 8 provide for a sliding or "wiping" engagement with the contact pads which will increase electrical engagement by removing dirt or light corrosion products from those surfaces. IC package 13 is then moved toward carrier assembly 30 so that contact pads 23, 24 engage top edge 6 and bottom edge 8.

Referring to FIGS. 15-23, various alternative spring shapes may be used in connection with the present invention. For example, electrical contact 2*a* may include a flat or vertical section 84 (FIGS. 15 and 16) that allows for a greater area of engagement between edges 42 of top sheet 33 and bottom sheet 36 and electrical contact 2. Alternatively, an electrical contact 2*b* may be fastened to the top surface of a contact pad 24 so as to project outwardly from that surface (FIGS. 17 and 18) to accommodate a wafer probe card that allows for a change in contact pitch. Also, a variety of compound spring electrical contacts 2*c* may be used in connection with the present invention in order to obtain varying degrees of compliance (FIGS. 19-23).

One alternative embodiment of electrical contact 2*d* comprises a compound spring shape that is formed from a plurality of pre-plated wires 90 that are adhesively fastened to one another along a common, intermediate section 92 (FIGS. 29-35). More particularly, electrical contact 2*d* includes a first free arm 95 and a second free arm 97 that emerge in divergingly spaced relation to one another from a central portion that is adhesively fastened to adjacent compound springs. Each free arm 95, 97 is cantilevered at the point along their respective lengths where each is adhesively fastened to adjacent compound spring contacts, but is free to move independently of the adjacent free arms of adjacent spring contacts. This structural arrangement provides for a relatively small size (i.e., relative to the center line spacing of contact pads 23 and contact pads 24, e.g., five mils or less) with a high but adjustable elastic compliance that allows for compressive deflections of as much as thirty percent of the uncompressed height of the contact 2*d*, and with low contact forces that are routinely less than twenty grams per electrical contact assembly. Advantageously, contact redundancies are provided for better reliability through the creation of parallel conduction paths between contact pads 23, 24. This construction creates both a mechanical and electrical engagement between each cantilevered arm 95, 97 provides electrical contact 2*d* with a capability for high frequency transmittance of signals greater than ten gigahertz, due to the low self-inductance created by a highly conductive short contact height. In addition, electrical contacts 2*d* are capable of high current capacity due to a bulk resistance that is often less than ten milliohms. The less than ten milliohms that is achieved is produced by parallel contact and bulk resistances which reduce the total resistance of the electrical interconnection by dividing a normally single, high resistance by the number of contact interface resistances that are arranged in parallel, as a result of the multiple or redundant contact spring engaged with contact pads 23,24.

Advantages of the Invention

Numerous advantages are obtained by employing the present invention. More specifically, an electrical contact assembly and connector system are provided which avoid the aforementioned problems associated with prior art devices. For one thing, an electrical contact assembly and connector system are provided that allows for a more simplified resilient conductive contact which incorporates the seemingly opposing requirements of good spring properties and high conductivity.

Additionally, an electrical contact assembly and connector system are provided that are extendible to a large contact array at fine pitch, i.e., five mils or less, with relatively small size, high elastic compliance, i.e., deflections of as much as thirty percent of the undeflected height of the electrical contact, and with low contact force, i.e., less than twenty grams per contact.

In addition, an electrical contact assembly and connector system are provided that are capable of high frequency transmittance of signals greater than ten gigahertz, due to low self-inductance created by a short contact height.

Also, an electrical contact assembly and connector system are provided that are capable of high current capacity, i.e., an electrical contact assembly having less than ten milliohm bulk resistance and low contact resistance.

Furthermore, an electrical contact assembly and connector system are provided that are capable of high durability or high cycles of touchdowns, i.e., greater than five hundred thousand cycles, utilizing a spring having a high elastic compliance that avoids permanent set in contact height under repeated compressive loadings and exhibits high fatigue strength.

Additionally, an electrical contact assembly and connector system are provided that are capable of high reliability with minimum degradation in contact resistance by employing a noble metal contact surface and redundancy in contact points via multiple, independent cantilevered beams, or folded grooved beams.

Also, an electrical contact assembly and connector system are provided that are capable of high service temperatures often exceeding two hundred and fifty degrees centigrade, by employing structural parts of the electrical contact formed of high melting temperature metals, such as 304V stainless steel, that prevent the relaxation of contact force at high temperatures.

Moreover, an electrical contact assembly and connector system are provided which avoid the aforementioned problems associated with prior art devices with low cost manufacturing, using conventional high volume tools and processes.

It is to be understood that the present invention is by no means limited only to the particular constructions herein disclosed and shown in the drawings, but also comprises any modifications or equivalents within the scope of the claims.

What is claimed:

1. An electrical contact comprising a compliant sheet comprising:

a first surface;

a second surface;

a longitudinal axis;

a transverse axis;

a first contact edge;

a second contact edge; and one or more folds, wherein a plurality of corrugations are formed in said first surface and said second surface, said corrugations being substantially parallel to the longitudinal axis and terminating at said first contact edge and at said second contact edge; and wherein the one or more folds are oriented substantially parallel to the transverse axis.

2. An electrical contact according to claim 1 wherein said compliant sheet comprises at least one transversely oriented crest that is separated by at least one transversely oriented trough created by the one or more folds.

3. An electrical contact according to claim 1 wherein the plurality of longitudinal corrugations are substantially sinusoidal and comprise 5 to 10 crests separated by troughs.

4. An electrical contact according to claim 2 wherein each base sheet is formed from hardened stainless steel comprising a yield strength in a range from about 275 ksi to about 325 ksi.

5. An electrical contact according to claim 4 wherein said compliant folded sheet comprises a vacuum melted, 304V stainless steel.

6. An electrical contact according to claim 2 wherein said base sheet is coated with a conductive metal selected from the group consisting of copper and gold.

7. An electrical contact according to claim 6 wherein said base sheet comprises a metal selected from the group consisting of hardened preplated stainless steel wire and hardened copper alloy wire.

8. An electrical contact according to claim 1 wherein said compliant folded sheet includes a conductive metal coating comprising a copper layer having a thickness in the range from two hundred microinches to four hundred microinches with a fifty microinch nickel layer over top said copper layer, and a fifty microinch gold over top said nickel layer.

9. An electrical contact according to claim 1 wherein said base sheet comprises a coating selected from the group consisting of electroplated, clad, and laminated.

10. An electrical contact according to claim 9 wherein said plating and said cladding is about ten percent to forty percent of the thickness of said base sheet.

11. An electrical contact according to claim 1 wherein said plurality of corrugations comprise a plurality of longitudinally oriented ridges that are spaced from one another by a plurality of longitudinally oriented furrows in a transverse sinusoidal pattern.

12. An electrical contact according to claim 11 wherein a first end of each longitudinally oriented ridge lies adjacent to a top contact edge and a second end of each longitudinally oriented ridge lies adjacent to a bottom contact edge so as to provide contact pad interface regions.

13. An electrical contact according to claim 12 wherein said top edge is concavely curved so as to produce a curved edge.

14. An electrical contact according to claim 13 wherein said bottom edge is substantially straight.

15. An electrical contact according to claim 11 comprising at least one of eight and ten longitudinally oriented ridges.

16. The electrical contact of claim 1, further comprising a carrier assembly, comprising:

a top sheet and a bottom sheet each formed from at least one of an insulator coated metal, a rigid polymer, and a polymer composite and having an array of through-holes through which a contact is located; and an inactivated layer of adhesive disposed between said top sheet and said bottom sheet so that said top sheet and said bottom sheet slide over one another so as to move from a first position in which said array of through-holes are arranged in coaxially aligned relation to one another thereby defining a first opening size, to a second position in which said top sheet and said bottom sheet transversely shifted relative to one another thereby defining a second opening size that is narrower than said first opening size.

17. An electrical contact according to claim 16 wherein said adhesive layer is activated with or without an applied pressure when said top sheet and said bottom sheet are arranged in said second position.

18. An electrical contact according to claim 16 wherein said inactive adhesive layer is prominently positioned along at least one edge defining each of said through-holes in said top sheet and said bottom sheet.

19. An electrical contact according to claim 16 wherein said through-holes are rectangular in shape.

20. The electrical contact of claim 1, in which:

the compliant folded sheet includes at least one crest corresponding to a top surface of a fold in said sheet and at least one trough corresponding to a bottom surface of a fold in said sheet, and defining a top contact edge and a bottom contact edge; and the plurality of corrugations formed in a top surface of said folded sheet and a bottom surface of said folded sheet are longitudinally oriented and form a plurality of longitudinally oriented rounded ridges that are transversely spaced from one another by a plurality of longitudinally oriented furrows.

21. The electrical contact of claim 1, in which the compliant folded sheet comprises:

a plurality of parallel wires arranged one next to another and fastened to one another along an intermediate portion of their length so as to form a compliant sheet defining a plurality of independent cantilevered wires projecting outwardly from said intermediate portion.

22. An electrical contact according to claim 21 wherein each of said wires are coated with a conductive metal selected from the group consisting of copper and gold.

23. An electrical contact according to claim 21 wherein each of said wires comprises a metal selected from the group consisting of hardened preplated stainless steel wire and hardened copper alloy wire.

24. A connector system comprising;

a carrier assembly including a top sheet and a bottom sheet each formed from at least one of an insulator coated metal, a rigid polymer, and a polymer composite and, having an array of through-holes;

an inactivated layer of adhesive disposed between said top sheet and said bottom sheet so that said top sheet and said bottom sheet slide over one another so as to move from a first position in which said array of through-holes are arranged in coaxially aligned relation to one another thereby defining a first opening size, to a second position in which said top sheet and said bottom sheet transversely shifted relative to one another thereby defining a second opening size that is narrower than said first opening size; and a plurality of electrical contacts, with one of said electrical contacts located in a corresponding one of said through-holes, each of said electrical contacts comprising:

a compliant folded sheet including a top surface, a bottom surface, a first contact edge and a second contact edge; and a plurality of corrugations formed in said top surface and said bottom surface that terminate at said first contact edge and said second contact edge.

25. The connector system of claim 24, in which the compliant folded sheet comprises a plurality of wires arranged one next to another and fastened to one another along an intermediate portion of their length so as to form a compliant sheet defining a plurality of independent cantilevered wires projecting outwardly from said intermediate portion and wherein said intermediate portion of each of said electrical contacts is located within a through-hole that comprises said second opening size.

26. The connector system of claim 25 wherein each of said wires are coated with a conductive metal selected from the group consisting of copper and gold.

27. The connector system of claim 25 wherein each of said wires comprises a metal selected from the group consisting of hardened preplated stainless steel wire and hardened copper alloy wire.

28. The connector system of claim 24, in which the compliant folded sheet includes at least one crest corresponding to a top surface of a fold in said sheet and at least one trough corresponding to a bottom surface of a fold in said sheet, and defining a top contact edge and a bottom contact edge; and the plurality of corrugations formed in a top surface of said folded sheet and a bottom surface of said folded sheet are longitudinally oriented and form a plurality of longitudinally oriented rounded ridges that are transversely spaced from one another by a plurality of longitudinally oriented furrows.

29. The connector system of claim 24 wherein said compliant folded sheet includes a conductive metal coating comprising a copper layer having a thickness in the range from two hundred microinches to four hundred microinches with a fifty microinch nickel layer over top said copper layer, and a fifty microinch gold over top said nickel layer.

30. The connector system of claim 24 wherein said base sheet comprises a coating selected from the group consisting of electroplated, clad, and laminated.

31. The connector system of claim 30 wherein said plating and said cladding is about ten percent to forty percent of the thickness of said base sheet.

32. The connector system of claim 24 wherein said adhesive layer is activated with or without an applied pressure when said top sheet and said bottom sheet are arranged in said second position.

33. The connector system of claim 24 wherein said inactive adhesive layer is prominently positioned along at least one edge defining each of said through-holes in said top sheet and said bottom sheet.

34. The connector system of claim 24 wherein said through-holes are rectangular in shape.

* * * * *